US007136604B2

(12) United States Patent
Chadani et al.

(10) Patent No.: US 7,136,604 B2
(45) Date of Patent: Nov. 14, 2006

(54) PROCESS CARTRIDGE HAVING ELECTRICAL CONTACT CONNECTABLE TO ELECTRICAL CONTACT IN ELECTROPHOTOGRAPHIC IMAGE FORMING APPARATUS

(75) Inventors: Kazuo Chadani, Shizuoka-ken (JP); Toshiyuki Karakama, Susono (JP); Shigeo Miyabe, Numazu (JP); Yoshiyuki Batori, Mishima (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/044,062

(22) Filed: Jan. 28, 2005

(65) Prior Publication Data

US 2005/0176299 A1 Aug. 11, 2005

(30) Foreign Application Priority Data

Jan. 30, 2004 (JP) ..... 2004-024341
Jan. 21, 2005 (JP) ..... 2005-014097

(51) Int. Cl.
*G03G 15/00* (2006.01)

(52) U.S. Cl. ..... 399/90; 399/111

(58) Field of Classification Search ..... 399/25, 399/90, 110, 111, 262, 88; 439/108, 939
See application file for complete search history.

(56) References Cited

U.S. PATENT DOCUMENTS 4,645,289 A * 2/1987 Isban ..... 439/101
5,456,621 A * 10/1995 Gan ..... 439/700
5,461,482 A * 10/1995 Wilson et al. ..... 347/50
5,500,714 A 3/1996 Yashiro et al. ..... 355/200
5,529,510 A * 6/1996 Wakata et al. ..... 439/310
5,768,660 A 6/1998 Kurihara et al. ..... 399/111
5,873,012 A 2/1999 Miyabe et al. ..... 399/90
5,926,666 A 7/1999 Miura et al. ..... 399/25
5,943,529 A 8/1999 Miyabe et al. ..... 399/111
5,946,531 A 8/1999 Miura et al. ..... 399/111
5,950,047 A 9/1999 Miyabe et al. ..... 399/111
6,029,031 A * 2/2000 Yokomori et al. ..... 399/109
6,064,843 A 5/2000 Isobe et al. ..... 399/111
6,128,452 A 10/2000 Miyabe et al. ..... 399/90
6,167,219 A 12/2000 Miyamoto et al. ..... 399/90
6,173,145 B1 1/2001 Chadani et al. ..... 399/265
6,178,302 B1 1/2001 Nagashima et al. ..... 399/106
6,253,036 B1 6/2001 Karakama et al. ..... 399/27
6,275,668 B1 8/2001 Batori ..... 399/90
6,535,699 B1 3/2003 Abe et al. ..... 399/27
6,594,454 B1 7/2003 Oguma et al. ..... 399/90

(Continued)

FOREIGN PATENT DOCUMENTS

JP 2003-330335 A 11/2003

*Primary Examiner*—Robert Beatty
(74) *Attorney, Agent, or Firm*—Fitzpatrick, Cella, Harper & Scinto

(57) ABSTRACT

A unit is detachably mountable to a main assembly of an electrophotographic image forming apparatus including a main assembly electrical contact and a rotatable electrical contact supporting member. The unit includes a unit electrical contact for electrically connecting with the main assembly electrical contact when the unit is mounted to the apparatus, and an engaging portion for engagement with the electrical contact supporting member when the unit is inserted into the main assembly of the apparatus. The engaging portion causes a rotational motion of the electrical contact supporting member when the unit is inserted into the main assembly, thereby imparting a sliding motion between the unit electrical contact and the main assembly electrical contact.

16 Claims, 19 Drawing Sheets

U.S. PATENT DOCUMENTS

| | | | | |
|---|---|---|---|---|
| 6,658,224 | B1 | 12/2003 | Yokoi et al. | 399/113 |
| 6,681,088 | B1 | 1/2004 | Kanno et al. | 399/111 |
| 6,704,525 | B1 | 3/2004 | Oguma et al. | 399/27 |
| 6,714,746 | B1 | 3/2004 | Morioka et al. | 399/27 |
| 6,782,219 | B1 | 8/2004 | Yoshino et al. | 399/90 |
| 6,804,475 | B1 | 10/2004 | Oguma et al. | 399/27 |
| 6,826,380 | B1 * | 11/2004 | Karakama et al. | 399/111 |
| 6,859,627 | B1 | 2/2005 | Karakama et al. | 399/27 |
| 6,892,035 | B1 | 5/2005 | Matsumoto et al. | 399/27 |
| 6,898,392 | B1 | 5/2005 | Karakama et al. | 399/90 |
| 2002/0191981 | A1 | 12/2002 | Miyabe et al. | 399/99 |
| 2003/0156848 | A1 * | 8/2003 | Kawai et al. | 399/27 |
| 2003/0215261 | A1 | 11/2003 | Karakama et al. | 399/111 |
| 2003/0235429 | A1 | 12/2003 | Sato et al. | 399/111 |
| 2004/0013446 | A1 | 1/2004 | Morioka et al. | 399/111 |
| 2004/0114961 | A1 | 6/2004 | Yoshino et al. | 399/119 |
| 2005/0019061 | A1 | 1/2005 | Karakama et al. | 399/111 |
| 2005/0025508 | A1 | 2/2005 | Karakama et al. | 399/27 |

* cited by examiner

PROCESS CARTRIDGE HAVING ELECTRICAL CONTACT CONNECTABLE TO ELECTRICAL CONTACT IN ELECTROPHOTOGRAPHIC IMAGE FORMING APPARATUS

FIELD OF THE INVENTION AND RELATED ART

The present invention relates to an electrophotographic image forming apparatus, and it also relates to a unit and a process cartridge, which are removably mountable in an electrophotographic image forming apparatus.

Here, an electrophotographic image forming apparatus is an apparatus which forms an image on a recording medium (for example, recording paper, an OHP sheet, etc.) with the use of one of the electrophotographic image forming processes. As for examples of an electrophotographic image forming apparatus, there are electrophotographic copying machines, electrophotographic printers (for example, laser printers, LED printers, etc.), facsimile machines, etc.

A unit is a developing means or a developer container, which is unitized to be removable from the main assembly of an electrophotographic image forming apparatus. A process cartridge is one of various types of units, and is a cartridge in which at least one among a charging means, a developing means and a cleaning means, as processing means, and an electrophotographic photosensitive drum, are integrally disposed, and which is removably mountable in the main assembly of an image forming apparatus, or a cartridge in which at least a developing means and an electrophotographic photosensitive drum are integrally disposed, and which is removably mountable in the main assembly of an image forming apparatus.

A process cartridge system which integrally places an electrophotographic photosensitive member, and a single or plurality of processing means which act on the electrophotographic photosensitive member, in a cartridge removably mountable in the main assembly of an electrophotographic image forming apparatus has long been used in the field of an electrophotographic image forming apparatus. A process cartridge system makes it possible for a user to maintain an electrophotographic image forming apparatus without relying on a service person, drastically improving an electrophotographic image forming apparatus in operational efficiency. Thus, it is widely used in the field of an electrophotographic image forming apparatus.

In order to form an image with the use of an electrophotographic image forming apparatus which employs a process cartridge system, voltage must be applied to the charging member for charging the electrophotographic photosensitive member in the process cartridge, and the developing member for developing an electrostatic latent image formed on the electrophotographic photosensitive member in the process cartridge. Also, communication must be possible between the storage elements in the process cartridge and the main assembly of the image forming apparatus. Therefore, an electrical connection must be established between the process cartridge and the main assembly.

Conventionally, the main assembly of an electrophotographic image forming apparatus is provided with electrical contacts designed for the main assembly, whereas a process cartridge is provided with electrical contacts designed for a unit (cartridge) to be connected with the electrical contacts on the main assembly side. Thus, as a process cartridge is mounted into the main assembly of an electrophotographic image forming apparatus, the electrical contacts on the main assembly side become connected to the electrical contacts on the process cartridge side, allowing the process cartridge to be supplied with voltage, and the main assembly and process cartridge to communicate with each other.

More concretely, the following structural arrangement has been known. The main assembly of an electrophotographic image forming apparatus is provided with electrical contacts for the main assembly, and a unit, which is to be mounted in the main assembly of an electrophotographic image forming apparatus is provided with electrical contacts for the unit, that is, electrical contacts which will be connected to the electrical contacts on the main assembly side, as the unit is mounted into the main assembly. Each of the electrical contacts on the main assembly side is provided with an area across which the corresponding electrical contact on the unit side is allowed to slide. With the employment of this structural arrangement, even if spots of scattered developer, or the like, are present on the electrical contacts on the main assembly and/or unit sides, they are removed (wiped away) as the unit is mounted into the main assembly. Therefore, it is assured that a reliable electrical connection is established between the electrical contacts on the main assembly side and those on the unit side as the unit is mounted into the main assembly (Japanese Laid-open Patent Application 2003-330335, p. 4–p. 6,p. 10, and FIGS. 6 and 13).

The present invention is one of the further developments of the above described prior art.

SUMMARY OF THE INVENTION

The primary object of the present invention is to provide a unit, a process cartridge and an electrophotographic image forming apparatus, which is superior to the prior art unit and apparatus, in terms of the level of reliability at which the electrical contact is established between the electrical contacts on the unit side and those on the main assembly side of the electrophotographic image forming apparatus, as the unit is mounted into the main assembly.

Another object of the present invention is to provide a unit, a process cartridge and an electrophotographic image forming apparatus, in which each of the electrical contacts on the unit side (cartridge side) slides on the corresponding electrical contact on the main assembly side, and vice versa, so that the contaminants, such as foreign substances, on the electrical contacts on both sides are removed by the sliding movement of the electrical contacts.

Another object of the present invention is to provide a unit, a process cartridge and an electrophotographic image forming apparatus, in which the electrical circuits, on the main assembly side of the electrophotographic image forming apparatus, to which the electrical contacts on the main assembly are connected, are more reliably protected than those in a combination of a unit and an electrophotographic image forming apparatus in accordance with the prior art.

According to an aspect of the present invention, there is provided a unit detachably mountable to a main assembly of the electrophotographic image forming apparatus, the electrophotographic image forming apparatus including a main assembly electrical contact and a rotatable electrical contact supporting member for supporting the main assembly electrical contact, the unit comprising a unit electrical contact for electrically connecting with the main assembly electrical contact when the unit is mounted to the main assembly of the apparatus; and an engaging portion for engagement with the electrical contact supporting member when the unit is inserted into the main assembly of the apparatus, the engaging portion being effective to cause a rotational motion of the electrical contact supporting member in a direction crossing an engaging direction in which the engaging portion is brought into engagement with the electrical contact supporting member, when the unit is being inserted into the main assembly of the apparatus, wherein a sliding motion is imparted between the unit electrical contact and the main assembly electrical contact by the engaging portion causing the rotational motion of the electrical contact supporting member, with the unit electrical contact and the main assembly electrical contact being contacted to each other.

According to another aspect of the present invention, there is provided a process cartridge detachably mountable to a main assembly of an electrophotographic image forming apparatus, the electrophotographic image forming apparatus including a main assembly electrical contact and a rotatable electrical contact supporting member for supporting the main assembly electrical contact, the process cartridge comprising an electrophotographic photosensitive member; process means actable on the electrophotographic photosensitive member; a cartridge electrical contact for electrically connecting with the main assembly electrical contact when the process cartridge is mounted to the main assembly of the apparatus; and an engaging portion for engagement with the electrical contact supporting member when the process cartridge is inserted into the main assembly of the apparatus, the engaging portion being effective to cause a rotational motion of the electrical contact supporting member in a direction crossing an engaging direction in which the engaging portion is brought into engagement with the electrical contact supporting member, when the process cartridge is being inserted into the main assembly of the apparatus, wherein a sliding motion is imparted between the cartridge electrical contact and the main assembly electrical contact by the engaging portion causing the rotational motion of said electrical contact supporting member, with the cartridge electrical contact and the main assembly electrical contact being contacted to each other.

According to a further aspect of the present invention, there is provided an electrophotographic image forming apparatus for forming an image on a recording material, wherein a unit is detachably mountable to a main assembly of the electrophotographic image forming apparatus, said apparatus comprising (i) a main assembly electrical contact; (ii) a rotatable electrical contact supporting member for supporting the main assembly electrical contact; (iii) mounting means for detachably mounting the unit, the unit including, a cartridge electrical contact for electrically connecting with the main assembly electrical contact when the process cartridge is mounted to the main assembly of the apparatus, and an engaging portion for engagement with the electrical contact supporting member when the unit is inserted into the main assembly of the apparatus, the engaging portion being effective to cause a rotational motion of the electrical contact supporting member in a direction crossing with an engaging direction in which the engaging portion is brought into engagement with the electrical contact supporting member, when the unit is being inserted into the main assembly of the apparatus, wherein a sliding motion is imparted between the unit electrical contact and the main assembly electrical contact by the engaging portion causing the rotational motion of the electrical contact supporting member, with the unit electrical contact and the main assembly electrical contact being contacted to each other; and feeding means for feeding the recording material.

According to an aspect of the present invention, there is provided an electrophotographic image forming apparatus for forming an image on a recording material, wherein a process cartridge is detachably mountable to a main assembly of the electrophotographic image forming apparatus, the apparatus comprising (i) a main assembly electrical contact; (ii) a rotatable electrical contact supporting member for supporting the main assembly electrical contact; (iii) mounting means for detachably mounting the process cartridge, the process cartridge including, a cartridge electrical contact for electrically connecting with the main assembly electrical contact when the process cartridge is mounted to the main assembly of the apparatus, and an engaging portion for engagement with the electrical contact supporting member when the unit is inserted into the main assembly of the apparatus, the engaging portion being effective to cause a rotational motion of the electrical contact supporting member in a direction crossing an engaging direction in which the engaging portion is brought into engagement with the electrical contact supporting member, when the process cartridge is being inserted into the main assembly of the apparatus, wherein a sliding motion is imparted between said cartridge electrical contact and the main assembly electrical contact by the engaging portion causing the rotational motion of the electrical contact supporting member, with the cartridge electrial contact and the main assembly electrial contact being contacted to each other; and the feeding means for feeding the recording material.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

Referring to FIG. 1, designated by reference letters Y, M, C, and Bk are first to fourth image formation stations, which form, one for one, yellow, magenta, cyan, and black toner images, respectively, the colors of which match, one for one, the four color components into which the optical image of a full-color image is separated. The four image formation stations are stacked in the main assembly 100 of the image forming apparatus, in the listed order starting from the bottom.

DETAILED DESCRIPTION OF THE PREFERRED EMBODIMENTS

Hereinafter, the electrophotographic image forming apparatus in accordance with the present invention, and the process cartridge, that is, a form of the unit removably mountable in the electrophotographic image forming apparatus, will be described in detail with reference to the appended drawings.

[Embodiment 1]

(1) General Structure of Electrophotographic Image Forming Apparatus

Figure 1:
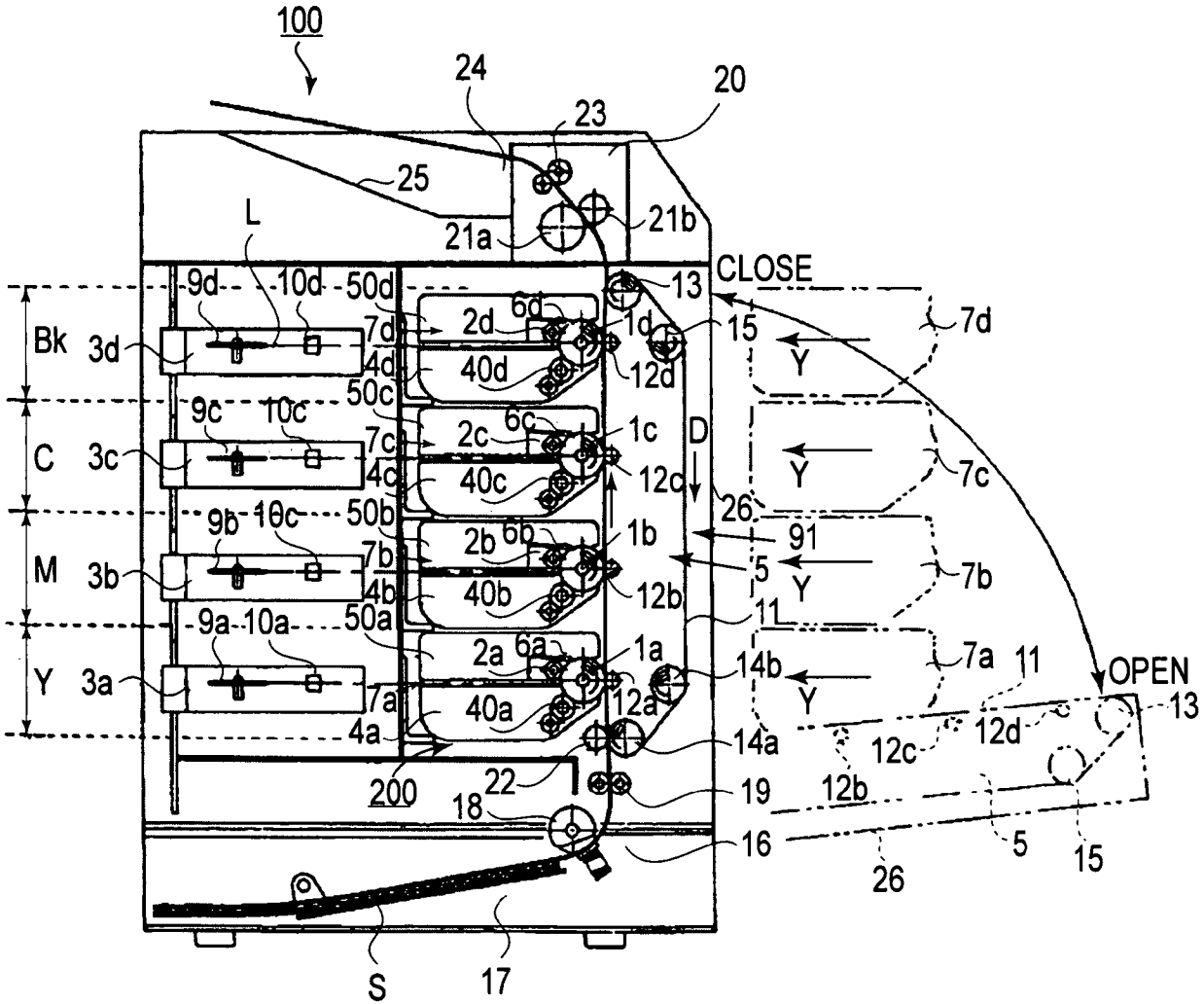
FIG. 1 is a sectional view of the electrophotographic image forming apparatus in the first embodiment of the present invention, showing the general structure thereof.

FIG. 1 is a sectional view of the electrophotographic image forming apparatus (which hereinafter may be referred to simply as image forming apparatus), showing the general structure thereof. The image forming apparatus in this embodiment is a full-color laser beam printer, which employs one of the electrophotographic processes of the transfer type, and is of the so-called tandem type.

Referring to FIG. 1, designated by reference letters Y, M, C, and Bk are first to fourth image formation stations, which form, one for one, yellow, magenta, cyan, and black toner images, respectively, the colors of which match, one for one, the four color components into which the optical image of a full-color image is separated. The four image formation stations are stacked in the main assembly 100 of the image forming apparatus, in the listed order starting from the bottom.

Each of the four image formation stations Y, M, C, and Bk comprises a set of devices for the electrophotographic process, for example, an electrophotographic photosensitive drum (which hereinafter may be referred to as photosensitive drum) as an image bearing member 1(*a–d*), a charging means 2(*a–d*), a scanner unit 3(*a–d*) as an exposing means, a development roller 40(*a–d*), a cleaning member 6(*a–d*), etc.

The scanner unit 3(*a–d*) is an exposing means for forming an electrostatic latent image on the peripheral surface of the photosensitive drum 1 by projecting a beam L of light onto the uniformly charged peripheral surface of the photosensitive drum 1(*a–d*) while modulating the beam L of light with image formation data. It is positioned at the same level as the photosensitive drum 1(*a–d*). It has a laser diode (unshown), a scanner motor (unshown), a polygon mirror 9(*a–d*), a focal lens 10(*a–d*), etc.

Designated by a reference numeral 5 is an electrostatic transferring means for transferring the toner image formed on the peripheral surface of each of the photosensitive drums 1(*a–d*) onto recording medium S (transfer medium). This electrostatic transferring means 5 comprises: an endless transfer belt 11; a driver roller 13; two follower rollers 14*a* and 14*b*; and a tension roller 15. The endless transfer belt 11 is stretched around the four rollers 13, 14*a*, 14*b*, and 15, being vertically extended with its outward surface placed in contact with the peripheral surface of each of the photosensitive drums 1(*a–d*), and is circularly driven. Designated by reference characters 12(*a–d*) are transfer rollers, which are positioned so that the transfer belt 11 remains pinched between the photosensitive drums 1(*a–d*) and transfer rollers 12(*a–d*), respectively, during the formation of an image.

Designated by a reference numeral 16 is a recording medium conveying portion, which is located in the bottom portion of the main assembly 100 of the image forming apparatus (which hereinafter may be referred to simply as apparatus main assembly), and conveys the recording medium S onto the transfer belt 11 of the electrostatic transferring means 5. The recording medium conveying portion 16 comprises a feeding cassette 17, in which a plurality of recording media S are stored. Designated by reference numerals 18, 19, and 22 are a conveyance roller, a pair of registration rollers, and an electrostatic adhesion roller, respectively.

Designated by a reference numeral 20 is a fixation station which is in the top portion of the apparatus main assembly 100. The fixation station 20 is a station for fixing to the recording medium S, a plurality of unfixed toner images different in color, which have just been transferred onto the recording medium S. It comprises: a heat roller 21*a*, which is rotationally driven; a pressure roller 21*b*, which is kept pressed against the heat roller 21 a to apply pressure to the recording medium S; a pair of discharge rollers 23; a sheet outlet portion 24; etc. Designated by a reference numeral 25 is a delivery tray which is located on top of the apparatus main assembly 100 to catch the recording medium S on which a permanent full-color image has just been formed.

The image formation stations Y, M, C, and Bk are sequentially driven in synchronism with the predetermined control timing of the image formation sequence, so that the photosensitive drum 1(*a–d*) in each image formation station rotates in the counterclockwise direction. The transfer belt 11 of the electrostatic transferring means 5 is circularly driven by the driver roller 13 in the clockwise direction, indicated by an arrow mark D, at a peripheral velocity equal to that of each photosensitive drum 1(*a–d*).

As each photosensitive drum 1(*a–d*) is rotationally driven, its peripheral surface is uniformly charged (primary charge) to predetermined polarity (negative polarity in this embodiment) and potential level by a charging means 2(*a–d*). The charged peripheral surface of the photosensitive drum 1 is exposed to the beam L of laser light outputted from the scanner unit 3(*a–d*) while being modulated with the image formation data. As a result, an electrostatic latent image in accordance with the image formation data is formed on the peripheral surface of each of the photosensitive drums 1(*a–d*). More specifically, the beam L of light modulated with video signals is outputted by the laser diode (unshown) of the unit 3(*a–d*), toward the polygon mirror 9(*a–d*) being rotated at a high velocity. After being deflected (reflected) by the polygon mirror 9, the beam L of light is focused on the charged peripheral surface of the photosensitive drum 1(*a–d*), selectively exposing numerous points of the charged surface of the photosensitive drum 1(*a–d*). As a result, an electrostatic latent image is formed on the peripheral surface of each of the photosensitive drums 1(*a–d*).

The electrostatic latent image is developed by the development roller 40(*a–d*) into a visible image (image formed of toner). In this embodiment, the latent image is reversely developed with the use of toner with the negative polarity. In other words, a visible image is formed on the peripheral surface of the photosensitive drum 1 in each image formation station; yellow, magenta, cyan, and black toner images are formed on the photosensitive drums 1*a*, 1*b*, 1*c*, and 1*d* in the image formation stations Y, M, C, and Bk, respectively, with the predetermined control timing for the image formation sequence. The yellow, magenta, cyan, and black colors are the color components into which the optical image of an intended full-color image is separated.

Meanwhile, the feed roller 18 of the sheet feeding portion 16 begins to be rotated with predetermined timing. As a result, the recording media S in the cassette 17 begin to be fed into the apparatus main assembly 100 while being separated one by one. After being fed into the apparatus main assembly 100, each recording medium S is temporarily held by the pair of registration rollers 19 as the leading edge of the recording medium S comes into contact with the nip between the pair of registration rollers 19, which are not rotating when the recording medium S comes into contact with the nip. Then, the pair of registration rollers 19 begins to be rotated in synchronism with the rotation of the transfer belt 11 and the formation of the toner image on the peripheral surface of the photosensitive drum 1(*a–d*), allowing thereby the recording medium S to be conveyed to the nip between the electrostatic adhesion roller 22 and transfer belt 11, and conveyed through the nip. While the recording medium S is conveyed through the nip between the electrostatic adhesion roller 22 and transfer belt 11, the recording medium S is pressed onto the outward surface of the endless transfer belt 11. In addition, while the recording medium S is conveyed through the nip between the adhesion roller 22 and transfer belt 11, voltage is applied between the transfer belt 11 and adhesion roller 22, inducing thereby electric charge between the recording medium S, which is formed of dielectric substance, and the dielectric layer of the transfer belt 11. As a result, the recording medium S is electrostatically adhered to the outward surface of the transfer belt 11, and therefore, it remains flatly adhered to the transfer belt 11 while it is conveyed to the most downstream point of the most downstream transfer station by the movement of the transfer belt 11.

To describe in more detail, the pair of registration rollers 19 are rotated to release the recording medium S with such timing that the recording medium S is conveyed to the transfer belt 11 so that the point in time, at which the leading edge of the toner image on the peripheral surface of the photosensitive drum 1*a* in the first image formation station Y, or the most upstream image formation station in terms of the moving direction of the transfer belt 11, arrives at the nip between the photosensitive drum 1*a* and transfer belt 11, coincides with the point in time at which the print-start line of the recording medium S arrives at the nip between the photosensitive drum 1*a* and transfer belt 11. With the provision of this arrangement, the recording medium S is conveyed upward from the transfer station of the first image formation station Y, or the most upstream image formation station, to the fourth image formation station Bk, or the most downstream image formation station, while remaining perfectly flatly adhered to the transfer belt 11.

While the recording medium S is conveyed as described above, the toner image on each of the photosensitive drums 1(*a–d*) is sequentially transferred in layers onto the recording medium S by the electric field generated between each of the photosensitive drums 1(*a–d*) and the corresponding transfer rollers 12(*a–d*). In this embodiment, positive electric charge is given to the recording medium S from each of the photosensitive drums 1(*a–d*) through the transfer belt 11. By the electric field generated by this electric charge, the toner image on each photosensitive drum 1, which is negative in polarity, is transferred onto the recording medium 5, which is in contact with the photosensitive drum 1.

To summarize, the recording medium S is held to the transfer belt 11 by being electrostatically adhered thereto, and is conveyed upward by the rotation of the transfer belt 11 through the transfer station of each of the first to fourth image formation stations Y, M, C, and Bk. While the transfer medium S is sequentially conveyed upward through the image formation stations Y, M, C, and Bk, the yellow, magenta, cyan, and black toner images formed on the photosensitive drums 1*a*, 1*b*, 1*c*, and 1*d*, respectively, are sequentially transferred in layers onto the recording medium media S. As a result, an unfixed full-color toner image is synthesized on the surface of the recording medium S.

After receiving in layers the four color toner images, the recording medium S is separated from the transfer belt 11 by its resiliency and the curvature of the drive roller 13, and then, is conveyed into the fixation station 20. In the fixation station 20, the recording medium S is conveyed through the nip formed by the rotating heat roller 21*a* and the pressure roller 21*b* kept pressed against the heat roller 21*a*. As a result, heat and pressure are applied to the recording medium S by the heat roller 21*a* and pressure roller 21*b*. Consequently, the plurality of unfixed toner images different in color, on the recording medium S, are fixed to the surface of the recording medium S. After the fixation of the toner images to the recording medium S, the recording medium S is discharged by the pair of discharge rollers 23 from the sheet outlet portion 24, into the delivery tray 25 located outside the apparatus main assembly 100.

In each of the first to fourth image formation stations Y, M, C, and Bk, after the transfer of the toner image onto the recording medium S, the residues on the peripheral surface of the photosensitive drum 1, such as the toner remaining the photosensitive drum 1 (*a–d*) after the transfer, are removed by the cleaning member 6(*a–d*), and the photosensitive drum 1 is used for the following image forming process.

(2) Process Cartridge

In the first to fourth image formation stations Y, M, C, and Bk, process cartridge cartridges 7(*a–d*) as image formation units are removably mounted, one for one. The process cartridges 7(*a–d*) comprise photosensitive drums 1(*a–d*), charging means 2(*a–d*), development rollers 40(*a–d*), and cleaning members 6(*a–d*), respectively. Each process cartridge 7 is removably mountable in the apparatus main assembly 100.

The procedure for mounting each of the above described cartridges 7(*a–d*) into the apparatus main assembly 100 or dismounting it therefrom is as follows. That is, each cartridge 7 is mounted or dismounted by exposing the cartridge insertion opening in the apparatus main assembly 100 by fully opening the front door 26 of the apparatus main assembly 100.

More specifically, the front cover of the apparatus main assembly 100 is in the form of the door 26 hinged to the apparatus main assembly 100 so that it can be open or closed, along with the electrostatic transferring means 5, relative to the main assembly 100. Thus, the door 26 can be rotated about the hinge 27 (FIG. 7) located at the bottom portion of the apparatus main assembly 100, into the position outlined by the double-dot chain line in FIG. 1, or the solid line in FIG. 7, by pulling the door 26 toward an operator. In other words, by pulling the door 26 toward an operator, the door 26 can be placed into the position in which it fully exposes the cartridge insertion opening 91. (FIG. 7) in the apparatus main assembly 100. Thus, by closing the door 26, the cartridge insertion opening 91 is covered (as outlined by solid line in FIG. 1). The procedure for mounting the cartridges 7(*a–d*) into the apparatus main assembly 100 or removing them from the apparatus main assembly 100 will be described in detail in the following Item (3).

In the following description of the present invention, the widthwise direction of the process cartridge or a given member thereof means the direction in which the process cartridge is mounted into, or removed from, the apparatus main assembly 100. The lengthwise direction of the process cartridge or a given member thereof means the direction intersecting the direction in which the process cartridge is mounted into, or removed from, the apparatus main assembly 100. Further, the rear side of the cartridge means the rear side as seen from the front side of the apparatus main assembly 100 when the cartridge is in the apparatus main assembly 100. The left or right side of a cartridge means the left or right side which will be on the left or right side as seen from the front side of the apparatus when the cartridge is in the apparatus main assembly 100. The top surface of a cartridge means the surface which will be the top surface when the cartridge is in the apparatus main assembly 100, and the bottom surface is the surface which will be the bottom surface when the cartridge is in the apparatus main assembly 100.

Figure 2:
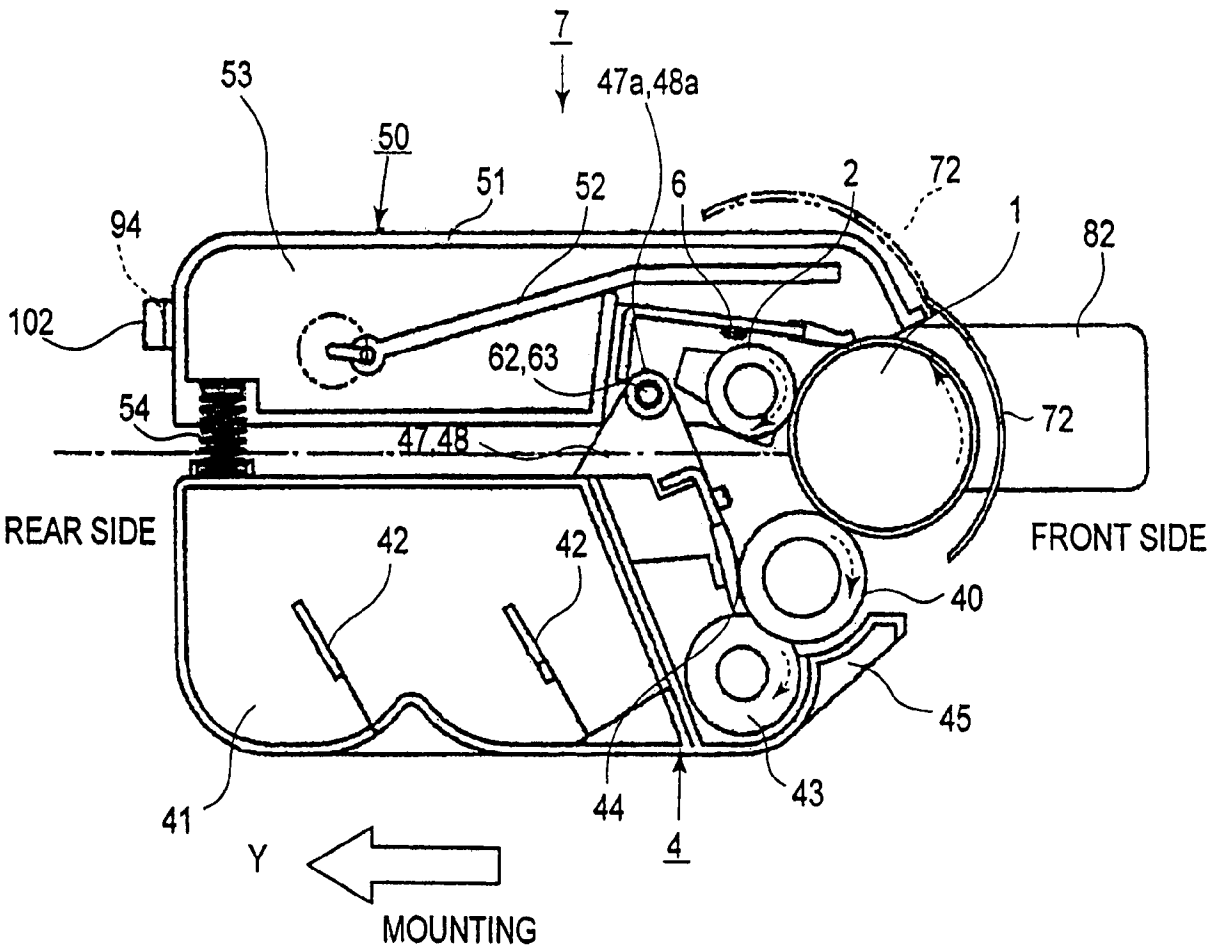
FIG. 2 is a sectional view of the process cartridge in the first embodiment of the present invention, showing the general structure thereof.
Figure 3:
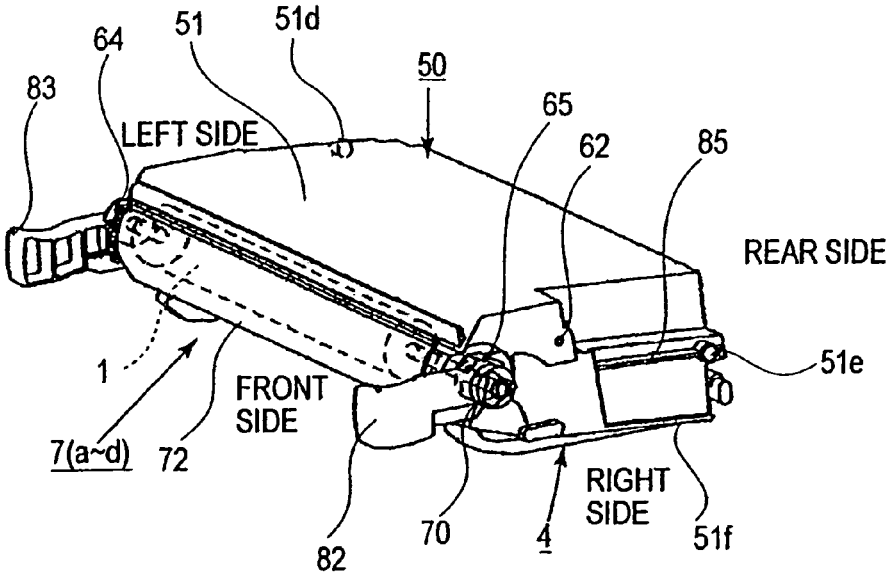
FIG. 3 is a schematic perspective view (No. 1) of the process cartridge.
Figure 4:
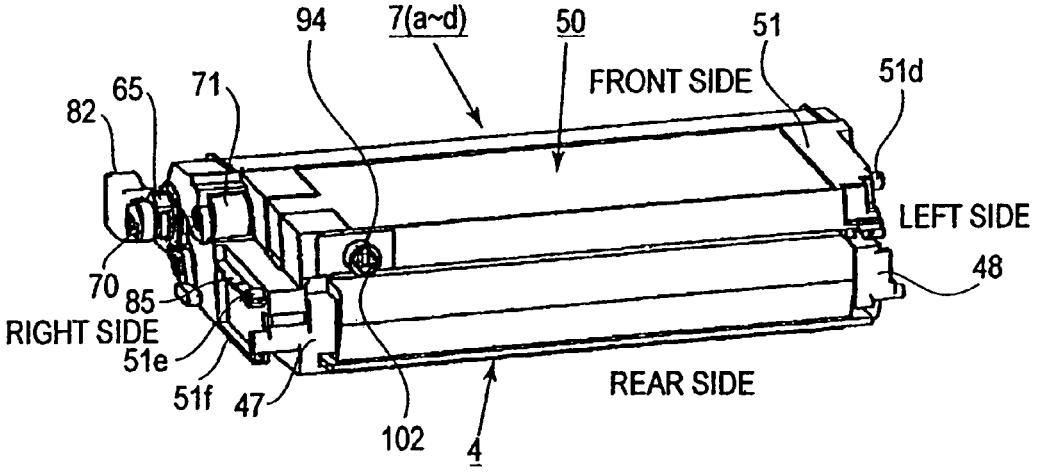
FIG. 4 is a schematic perspective view (No. 2) of the process cartridge.
Figure 5:
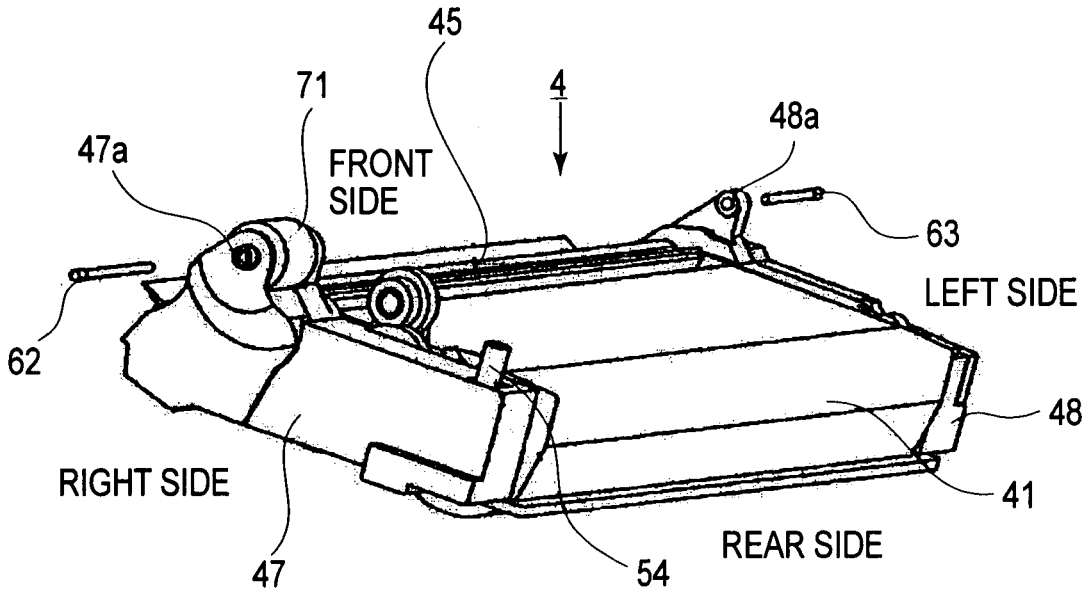
FIG. 5 is a schematic perspective view (No. 1) of the development unit of the process cartridge.
Figure 6:
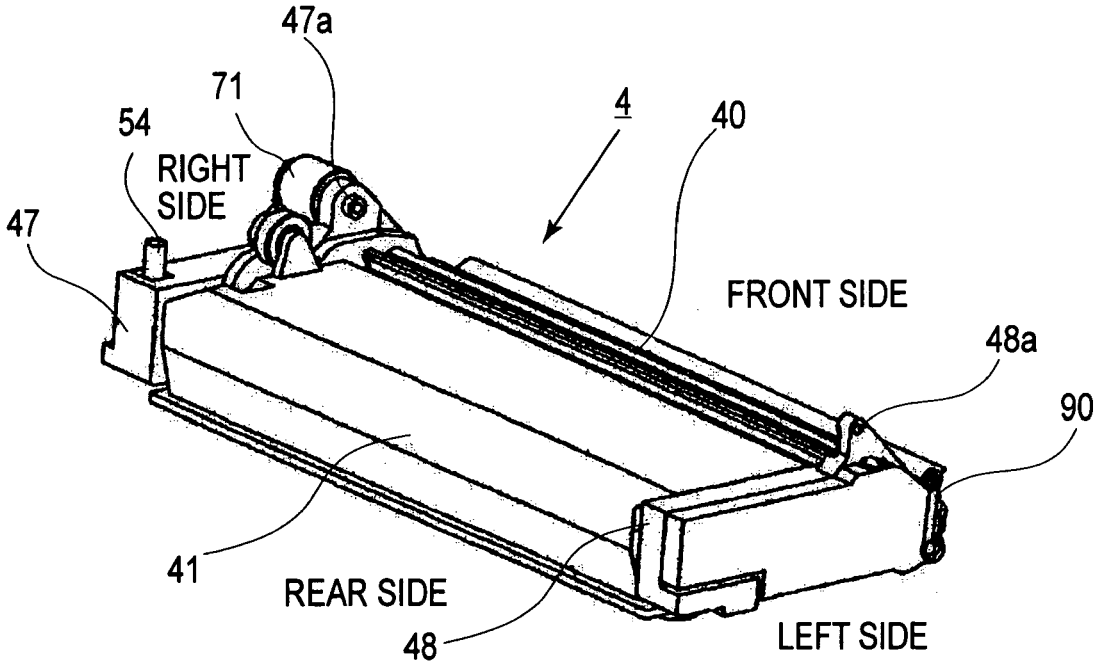
FIG. 6 is a schematic perspective view (No. 2) of the development unit of the process cartridge.

FIG. 2 is a sectional view of the cartridge 7, and FIGS. 3 and 4 are schematic perspective views of the cartridge 7. FIGS. 5 and 6 are schematic perspective views of the development unit of the cartridge 7.

As for the developer stored in the toner container of the developing means in each of the cartridges 7(*a–d*) in the first to fourth image formation stations Y, M, C, and Bk, respectively, the developer in the cartridge 7*a* in the first image formation station Y is toner with yellow color; the developer in the cartridge 7*b* in the second image formation station M is toner with magenta color; the developer in the cartridge 7*c* in the third image formation station C is toner with cyan color; and the developer in the cartridge 7*d* in the fourth image formation station Bk is toner with black color. The four process cartridges are identical in structure, although they are different in the color of the toner therein. Therefore, the structure of only one of the process cartridges 7 will be described.

Referring primarily to FIG. 2, each cartridge 7 has a cleaning unit 50, or a first unit, and a development unit 4, or a second unit. The cleaning unit 50 comprises the photosensitive drum 1, charging means 2, and cleaning means 6, whereas the development unit 4 comprises the developing means.

To the unit 50, the photosensitive drum 1 is rotatably attached. In the adjacencies of the peripheral surface of the photosensitive drum 1, the charging means 2 and cleaning member 6 are disposed in contact therewith as described above. After being removed from the peripheral surface of the photosensitive drum 1 by the cleaning member 6, the residual toner is sent to a toner chamber 53 for removed toner, which is located behind the cleaning unit frame 51. As the charging means 2, one of the charging means of the contact type is employed. The charging member is in the form of an electrically conductive roller, and is placed in contact with the peripheral surface of the photosensitive drum 1. As charge bias voltage is applied to the charge roller, the peripheral surface of the photosensitive drum 1 is uniformly charged.

The development unit 4 comprises the toner container 41 and a development unit frame 45. The toner in the toner container 41 is sent to a toner supply roller 43 by a toner conveyance mechanism 42, and then, is uniformly coated on the peripheral surface of the development roller 40 by the abovementioned toner supply roller 43, and the development blade 44 as a developing member kept pressed upon the peripheral surface of the development roller 40, while being frictionally charged. Then, as development bias is applied to the development roller 40, the latent image formed on the peripheral surface of the electrophotographic photosensitive drum 1 is developed. Incidentally, the development roller 40 is disposed opposing the photosensitive drum 1.

The photosensitive drum 1 is rotatably supported by its lengthwise ends by a pair of supporting members 64 and 65

(FIG. 3), which are supported by the cleaning unit frame 51. One of the lengthwise ends of the photosensitive drum 1 is provided with a coupling member 70 to which a driving force is transmitted from a motor (unshown) with which the apparatus main assembly 100 is provided. With the provision of this structural arrangement, the photosensitive drum 1 can be rotationally driven in the counterclockwise direction with reference to FIG. 2. The rotation of the photosensitive drum 1 is transmitted through a gear train (unshown) to the toner conveyance mechanism 42 in the toner chamber 53 for removed toner, to drive the toner conveyance mechanism 42.

The pair of supporting members 64 and 65 are supported by a pair of handles 82 and 83 to be used for mounting the cartridge 7 into the main assembly 100 of an image forming apparatus, and also, are supported by the cleaning unit frame 51. The cleaning unit frame 51 is provided with a shutter 72 for protecting the photosensitive drum 1. The shutter 72 is enabled to be closed into the position (FIGS. 2 and 3) in which it covers the drum exposure window, and also, is enabled to be opened upward (or downward) into the position (outlined by double-dot chain line in FIG. 2) in which it exposes the drum exposure opening, by an opening and closing mechanism 7. When the cartridge 7 is out of the apparatus main assembly 100, the shutter 72 is held in the closed position, covering thereby the drum exposure opening to protect the peripheral surface of the photosensitive drum 1. Further, as the front door 26 (FIG. 1) of the apparatus main assembly 100 is closed after the insertion of the cartridge 7 into the apparatus main assembly 100, the shutter 72 is moved into the open position by a means which is moved by the closing movement of the front door 26. As a result, the transfer belt 11 comes into contact with the peripheral surface of the photosensitive drum 1.

The development unit 4 is connected to the cleaning unit 50 as if it is suspended from the cleaning unit 50 so that it can be pivoted about the axial line of the joint between the two units. More specifically, referring to FIGS. 5 and 6, the development unit 4 is provided with a pair of bearing members 47 and 48, which are attached to the lengthwise ends of the unit 4, one for one, and are provided with holes 47*a* and 48*a*, respectively, the axial lines of which coincide with the pivotal axes of the unit 4. A pair of connective shafts 62 and 63 are inserted into the holes 47*a* and 48*a*, respectively, through the corresponding connective holes of the cleaning unit frame 51. As a result, the development unit 4 is pivotally connected to the cleaning unit frame 51 (FIG. 2).

The cartridge 7 is structured so that when it is not in the main assembly of an image forming apparatus, the development unit 4 remains under the pressure which acts in the direction to rotate the development unit 4 about the connective shafts 62 and 63 inserted in the hole 47*a* and 48*a*, the rotational axes of which coincide with the rotational axes of the bearing members 47 and 48, so that the development roller 40 is kept in contact with the photosensitive drum 1. For this purpose, the lengthwise end of the cartridge 7, on the bearing 47 side, is provided with a compression spring 54, as a means for pressing the development unit 4, which is positioned between the development unit 4 and cleaning unit 50, at the widthwise end, on the opposite side of the connective shafts 62 and 63 from the photosensitive drum 1, and the lengthwise end of the cartridge 7, on the bearing 48 side, is provided with a tension spring 90 (FIG. 6) as a means for pulling the development unit 4, which also is positioned between the unit 50 and development unit 4.

Designated by a reference numeral 71 (FIGS. 4–6) is a cartridge driving gear (helical gear) with which the development unit 4 is provided. When the cartridge 7 is in the apparatus main assembly 100, the cartridge driving gear 71 meshes with the driving gear (unshown helical gear) on the main assembly side, and receives a driving force from the driving gear on the main assembly side. By the rotation of this driving gear 71, the development roller 40 the toner conveyance mechanism 42, and the toner supply roller 43 are driven through the gear train (unshown).

Designated by reference numerals 94 and 102 (FIGS. 2 and 4) are a memory (which will be described later), and the connective (coupling) member attached to the rear surface of the cleaning unit frame 51. The connective member 102 is to be engaged with the electrical contact supporting member on the main assembly side. These members will be described in detail in Item (4).

(3) Method for Mounting Process Cartridge

Next, referring to FIGS. 7 and 8, the method for mounting the cartridge 7 into the apparatus main assembly 100 will be described.

Figure 7:
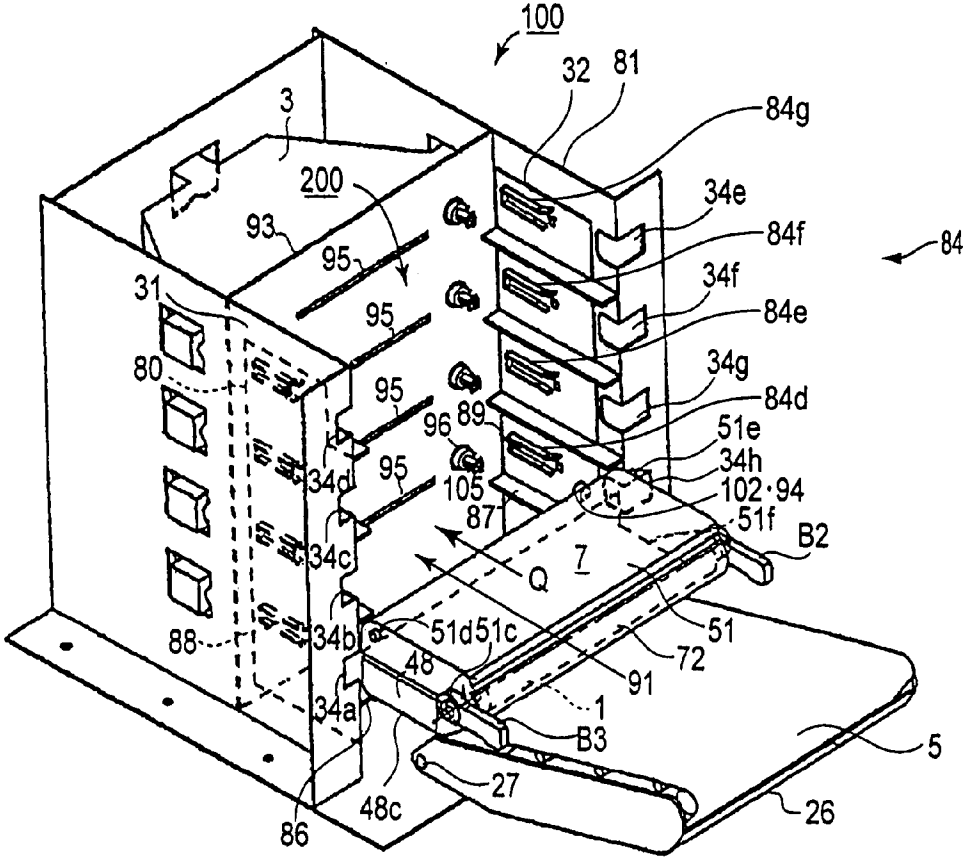
FIG. 7 is a perspective view showing the method of mounting the process cartridge.

Referring primarily to FIG. 7, as described above, the operation for mounting each of the cartridges 7(*a*–*d*) into the apparatus main assembly 100, or removing it therefrom, is carried out after the cartridge insertion opening 91 in the apparatus main assembly 100 is widely exposed by opening the front door 26 of the apparatus main assembly 100. When the door 26 is in the closed position, it is locked to the apparatus main assembly 100 with a latching mechanism (unshown). Thus, when opening the front door 26, first, the door 26 is to be unlocked by unlatching the latching mechanism, and the door 26 is to be opened toward an operator by rotating the door 26 about the hinge shaft 27 located at the bottom edge of the door 26. As the front door 26 is opened all the way, the cartridge insertion opening 91 in the apparatus main assembly 100 becomes fully exposed.

Inward of the cartridge insertion opening 91, there are four pairs of guides 80 and 81 attached to the inward surfaces of the side plates 31 and 32 of the apparatus main assembly 100 in order to guide the cartridges 7 into the image formation positions. The cartridge insertion opening 91 is tall enough to expose all four cartridge compartments all at once. The cartridge compartments are vertically stacked. The bottommost cartridge compartment is for the cartridge containing yellow developer (toner), and the rest are stacked in the order of magenta, cyan, and black cartridges on top of the bottommost compartment.

The compartments for the cartridges 7 for yellow, magenta, cyan, and black color are identical in structure. Thus; the method for mounting the cartridge 7 into the apparatus main assembly 100 will be described with reference to the bottommost cartridge compartment, or the compartment for the cartridge 7*a* for yellow color.

First, an operator is to lift the cartridge 7 by grasping with his left and right hands the left and right handles 82 and 83 located at the lengthwise ends of the cartridge 7, more specifically, the lengthwise ends of the cleaning unit 50, and to insert the cartridge 7 into the cartridge compartment inside the cartridge insertion opening 91 in the direction indicated by an arrow mark Q, with the rear side of the cartridge, that is, the opposite side of the cartridge 7 from the photosensitive drum 1, in terms of the widthwise direction of the cartridge 7, facing forward.

The guides 80 and 81 of the main assembly 100 are provided with rough guides 86 and 87, respectively, which support the cartridge 7 by the bottom surfaces of the lengthwise end portions of the cartridge 7. The operator is to insert the cartridge into the cartridge compartment so that the bottom surface 48*c* of the bearing member 48 of the cartridge 7, and the bottom surface 51*f* of the cleaning unit frame 51, rest on the rough guides 86 and 87, respectively. The guides 80 and 81 of the apparatus main assembly 100 are also provided with boss guides 88 and 89, respectively, into which the bosses 51*d* and 51*e*, with which the lengthwise end walls of the cleaning unit frame 51 are provided, fit to regulate the rotation of the cartridge 7 in the apparatus main assembly 100. As the cartridge 7 is further inserted, the bosses 51*d* and 51*e* come into contact with the boss guides 88 and 89, and ride onto them, being thereby guided, respectively.

Further, the guide 81 of the main assembly 100 is provided with a pressing means 84 (84*d*–84*g*, listing from bottom side) for pressing the cartridge 7 in the lengthwise direction. The cartridge pressing means 84 comes into contact with the right end surface of the cartridge 7, more specifically, the guiding portion 85 (FIG. 3) on the right end surface of the cleaning unit frame 51 in this embodiment, and presses the cartridge 7 in the lengthwise direction, that is, toward the left side plate 31 of the apparatus main assembly 100.

Then, as the cartridge 7 is further inserted into the apparatus main assembly 100, the above-mentioned guiding portion 85 of the cartridge 7 comes under the pressure from the pressing means 84. Therefore, while the cartridge 7 is further inserted, the cartridge 7 remains pressured toward the left side plate 31 of the apparatus main assembly 100, that is, the opposite side plate from the right side plate 32 to which the pressing means 84 is attached. Further, one of the lengthwise ends of the cleaning unit frame 51 is provided with a positioning portion 51*c* for accurately positioning the cartridge 7 in the apparatus main assembly 100. That is, as this positioning portion 51*c* comes into contact with the end surface of the insert guide 80 of the apparatus main assembly 100, the position of the cartridge 7 in the apparatus main assembly 100 becomes fixed in terms of the lengthwise direction.

There is extended a center plate 93 between the side plates 31 and 32 of the apparatus main assembly 100. The center plate 93 is provided with four exposure windows which allow the beam L of laser light from each scanner 3 to pass. Also, the center plate 93 is fitted with four electrical contact supporting rotatable members 105 for supporting the electrical contacts on the main assembly side. The electrical contact supporting members 105 are protruding into the cartridge compartments 200 through the four holes 96, one for one, with which the center plate 93 is provided. The electrical contacts on the main assembly side come into contact with the electrical contacts on the unit side, which are electrically connected with the memory 94 which stores the information regarding the cartridge 7; they are for establishing electrical connection between the memory 94 of the cartridge 7 and the apparatus main assembly 100.

Figure 8:
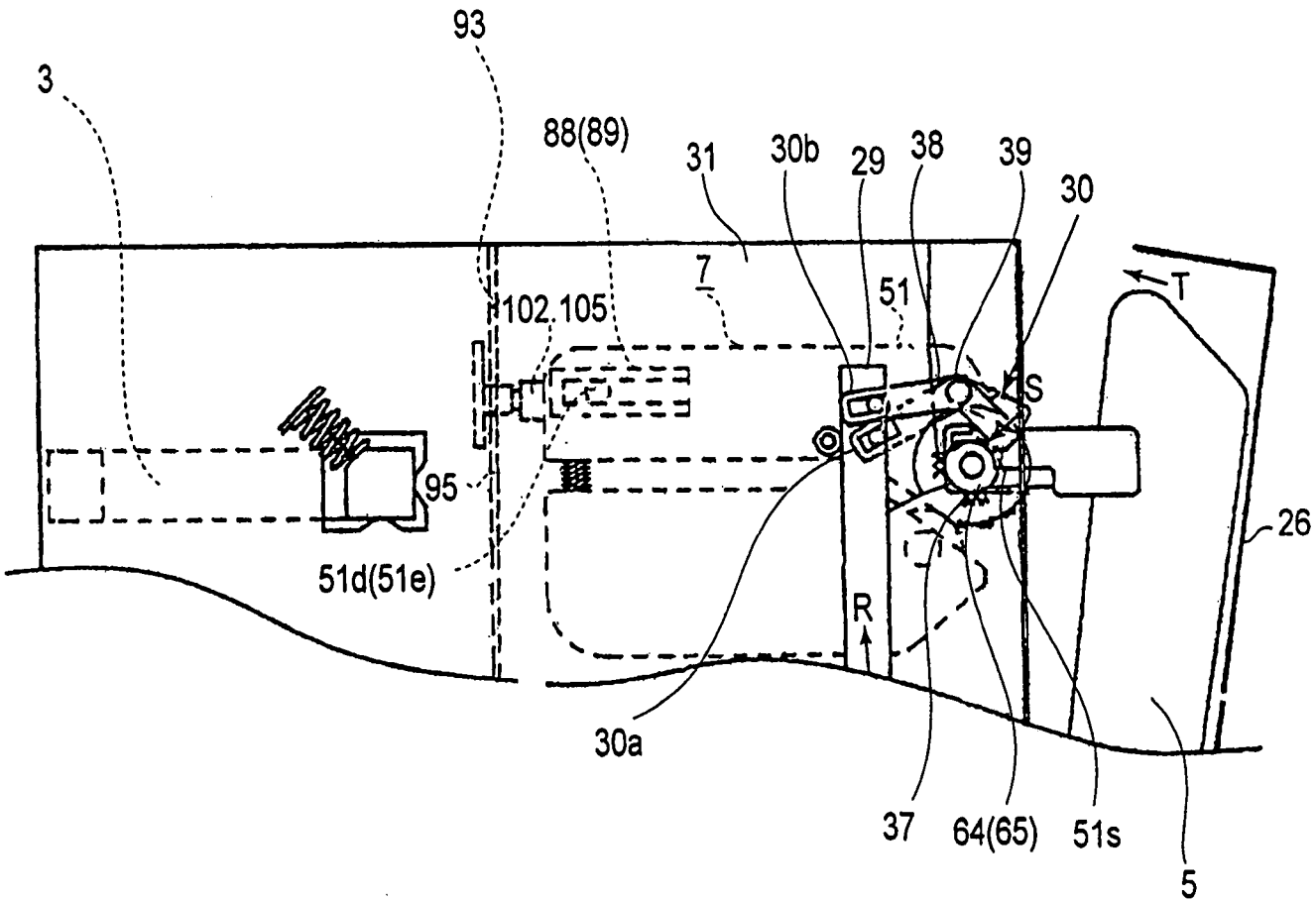
FIG. 8 is a schematic side view of the cartridge positioning mechanism of the main assembly of the electrophotographic image forming apparatus, which is for precisely positioning the process cartridge in terms of the widthwise direction of the process cartridge, in the main assembly of the electrophotographic image forming apparatus.

Referring to FIG. 8, the bearings 64 and 65 which support the photosensitive drum 1 are inserted along the guiding grooves 34*a* and 34*h*, respectively, until the bearings 64 and 65 are pressed against the contact areas 37 and 38 of the guiding grooves 34*a* and 34*h* so that the position of the cartridge 7 relative to the apparatus main assembly 100 in terms of the widthwise direction becomes fixed. That is, when the bearings 64 and 65 are in contact with the contact areas 37 and 38 of the guiding grooves 34*a* and 34*h*, the bearings 64 and 65, and the bosses 51*d* and 51*e* protruding, one for one, from the lengthwise end surfaces of the cleaning unit frame 51, are precisely positioned relative to the apparatus main assembly 100 by the boss guides 88 and 89.

The cartridge 7 is inserted until the bearings 64 and 65 are caught by the contact areas of the guiding grooves 34*a* and 34*h* by coming into contact with the contact areas 37 and 38 of the guiding grooves 34*a* and 34*h*. Then, at the very end of the process of mounting the cartridge 7 into the apparatus main assembly 100, the connective (coupling) portion 102 located on the rear surface of the cartridge 7 fully engages with the electrical contact supporting member 105 protruding into the cartridge compartment 200 through the aforementioned hole 96. In this embodiment, the electrical contacts, on the unit side, which are in electrical connection with the memory 94 of the cartridge 7, are placed in contact with the electrical contacts on the main assembly side, establishing thereby the electrical connection between the memory 94 and the apparatus main assembly 100. This arrangement will be described later.

Further, the electrical contact of the development bias unit (unshown), with which the cartridge 7 is provided for development bias application is placed in contact with the electrical contact (unshown) with which the apparatus main assembly 100 is provided for development bias application, establishing thereby electrical connection between the two electrical contacts.

Further, the driving gear 71 of the cartridge 7 is meshed with the driving gear (unshown) of the apparatus main assembly 100.

As for the cartridges 7*b*, 7*c*, and 7*d*, they are inserted into the corresponding cartridge compartments in the same manner as the cartridge 7*a* is inserted into the bottommost cartridge compartment as described above.

Next, the open front door 26 is to be closed against the apparatus main assembly 100, and the door is to be locked with the latching mechanism (unshown). This closing movement of the front door 26 causes the following actions through a means, the movement of which is caused by the movement of the front door 26:

1) positioning of each of the cartridges 7 within the apparatus main assembly 100 in terms of the widthwise direction;

2) moving the shutter 72 of each cartridge 7 into the open position; and 3) engaging the coupling 70 of each cartridge 7 with the corresponding driving force transmission coupling of the apparatus main assembly 100.

More specifically, 1) positioning of the shutter 72 of each cartridge 7 in terms of the widthwise direction is done by a pressing means 30, the movement of which is caused by the movement of the mechanism for opening or closing the door 26 to the inward side of which the electrostatic transferring means 5 is attached. The pressing member 30 is rotatably attached to a shaft 39 crimped to the side plate 31. It is engaged with a connective member 29, the movement of which is caused with the opening or closing movement of the door 26. Thus, when the door 26 is open, in other words, when the apparatus main assembly 100 is in the state in which the process cartridges 7 are mountable into the apparatus main assembly 100 or dismountable, the pressing member 30 is in a position 30*a*, into which the pressing member 30 is retracted. While the cartridge 7 is inserted, the pressing member 30 does not come into contact with the cartridge 7. However, as the door 26 is closed after the insertion of the cartridge 7, the connective member 29 is moved in the direction indicated by an arrow mark R by the closing movement (in direction indicated by arrow mark T) of the door 26, and the pressing member 30 is moved into the position 30*b* by the movement of the connective member 29, in which it presses on the slanted surface 51*s* of the cleaning unit frame 51, located near the bearing 64, in the direction indicated by an arrow mark S. As a result, the cartridge 7 is precisely positioned in the apparatus main assembly 100 in terms of its widthwise direction. There is also provided a similar mechanism on the side plate 32 side. In other words, the cartridge 7 is pressed by its lengthwise ends by the pair of pressing members 30.

After the mounting of each of the cartridges 7 into the apparatus main assembly 100, the coupling 70 of each cartridge 7 is in engagement with the corresponding driving force transmission coupling on the main assembly 100 side. Therefore, the driving force from the motor (unshown) on the apparatus main assembly 100 side can be transmitted to the coupling 70 on the cartridge 7 side to rotationally drive the photosensitive drum 1 of the cartridge 7 in the counter-clockwise direction in FIG. 1, and the toner conveyance mechanism 52 in the toner chamber 53 for removed toner can be driven by the rotation of the photosensitive drum 1 through the unshown gear train.

Further, the cartridge driving gear 71 of each cartridge 7 meshes with the driving gear (unshown) on the main assembly 100 side. Therefore, the driving gear 71 can receive the driving force from the driving gear on the main assembly 100 side, and the development roller 40, the toner conveyance mechanism 42, and toner supply roller 43 in each cartridge 7 are driven by the rotation of the driving gear 71 through a gear train (unshown).

Further, the development bias application electrical contact (unshown) of each cartridge 7 is in contact with the electrical contact on the apparatus main assembly 100 side, establishing thereby electrical contact between the development bias application electrical contact on the cartridge 7 side and the power source (unshown) on the main assembly 100 side, making it therefore possible for the development bias to be applied to the development roller 40 in each cartridge 7 from the power source on the main assembly 100 side.

Further, the connective (coupling) portion 102 on the rear surface of each cartridge 7 is in engagement with the electrical contact supporting member 105, on the main assembly side, which is protruding through the hole 96 of the center plate 93, establishing electrical contact between the electrical contacts on the unit side and the electrical contacts on the main assembly 100 side, making it possible for electrical data to be exchanged between the memory 94 of the cartridge 7 and the control circuit portion 113 on the main assembly 100 side.

As for the removal of each cartridge 7 from the apparatus main assembly 100, it is done by performing in reverse the above described procedure for mounting the cartridge 7 into the apparatus main assembly 100. That is, first, the aforementioned latching mechanism (unshown) is to be disengaged, and then, the door 26 is to be opened toward the operator by rotating it downward about the hinge shaft 27 located at the bottom edge of the door 26. As the door 26 is opened, the process cartridges 7 are relieved by the means, which is moved by the movement of the door 26, of the pressure being applied thereto by the pressing means 30, and also, the driving force transmission coupling on the main assembly 100 side is disengaged from the coupling 70 on the cartridge 7 side by the opening movement of the door 26. Further, the shutter 72 is moved into the closed position. Thereafter, the operator is to grasp the handles 82 and 83 of the process cartridge 7, and pull the cartridge 7 in the opposite direction from the direction in which the cartridge 7 is inserted into the apparatus main assembly 100. This makes the cartridge 7 come out of the apparatus main assembly 100.

(4) Description of Mechanical Structure of Electrical Contacts

Next, the mechanical structure of the electrical contacts on the main assembly side will be described.

As described before, each cartridge 7 is provided with the memory 94 and connective (coupling) member 102, which are attached to the rear surface of the cartridge 7, more specifically, the rear surface of the cleaning unit frame 51. The connective (coupling) member 102 engages with the electrical contact supporting member on the main assembly side. As for the apparatus main assembly 100, it provided with the rotatable electrical contact supporting members 105, which support the electrical contacts 103 and 104 on the main assembly side, and which protrude into the cartridge compartments through the holes 96 of the center plate 93. As described before, the process cartridge 7 is to be inserted into the cartridge compartment 200 of the apparatus main assembly 100, with the rear surface of the cartridge 7 facing forward through the opening 91, until the bearings 64 and 65 of the cartridge 7 are caught by the contact areas of the 37 and 38 of the guiding grooves 34, respectively (FIG. 8). As the cartridge 7 is inserted into the apparatus main assembly 100 as described above, the connective (coupling) member 102 of the cartridge 7 engages with the electrical contact supporting member 105 on the apparatus main assembly 100 side; the electrical contacts on the unit side are placed physically in contact with the electrical contacts on the main assembly side, establishing thereby an electrical connection between the electrical contacts on two sides (FIG. 8, and FIGS. 9(*a*)–9(*c*)). The connective (coupling) member 102 is provided at a leading end of the cartridge 7 with respect to the mounting direction in which the cartridge 7 is mounted to the main assembly 100 of the apparatus.

The connective (coupling) member 102 is located at the forward surface of the cartridge 7 in terms of the direction in which the cartridge 7 is inserted into the apparatus main assembly 100.

Figure 10:
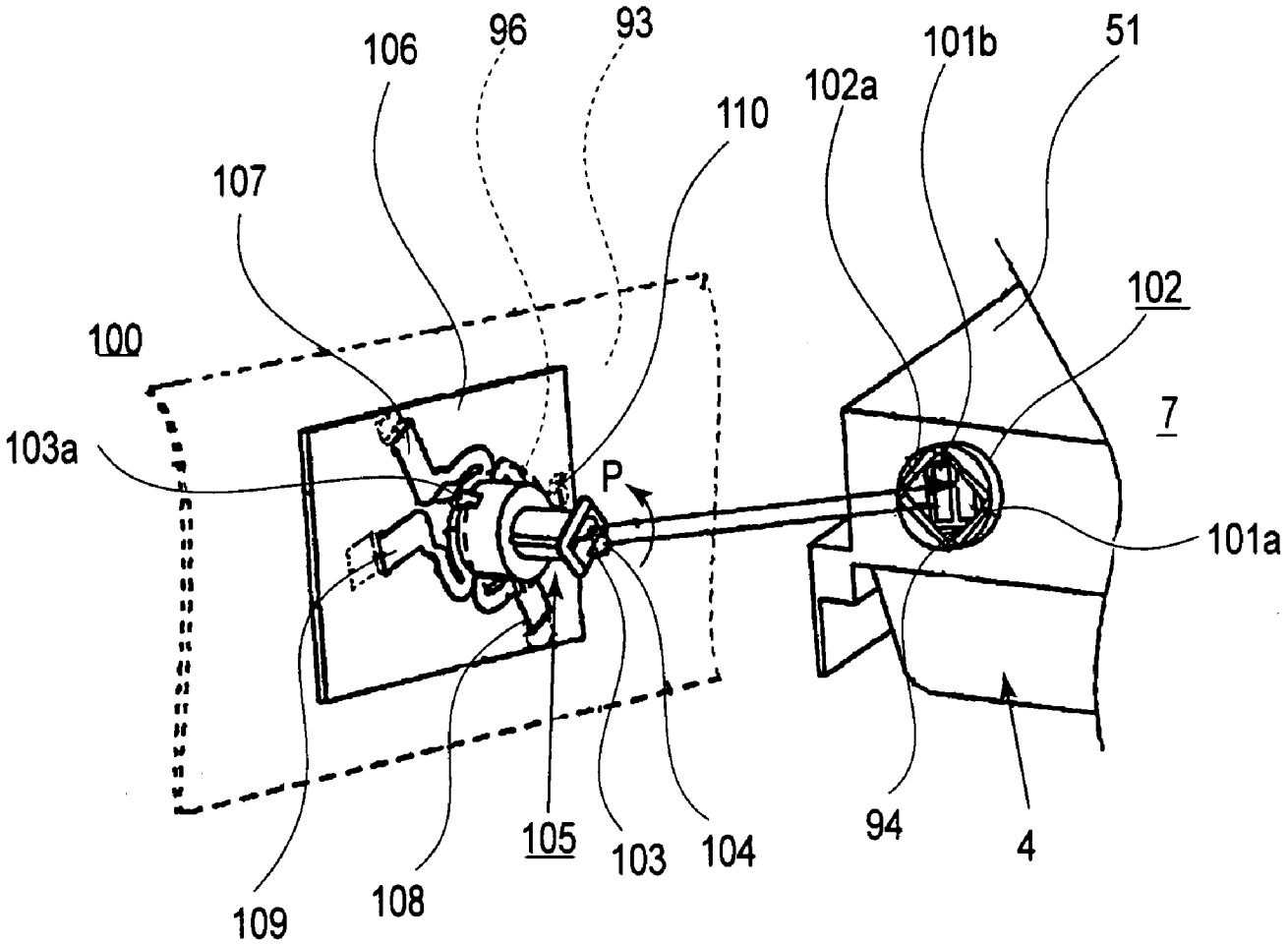
FIG. 10 is a schematic perspective view of the connective (coupling) portion of the process cartridge, and the electrical contact supporting member, on the main assembly side, which corresponds to the connective portion of the process cartridge.
Figure 11:
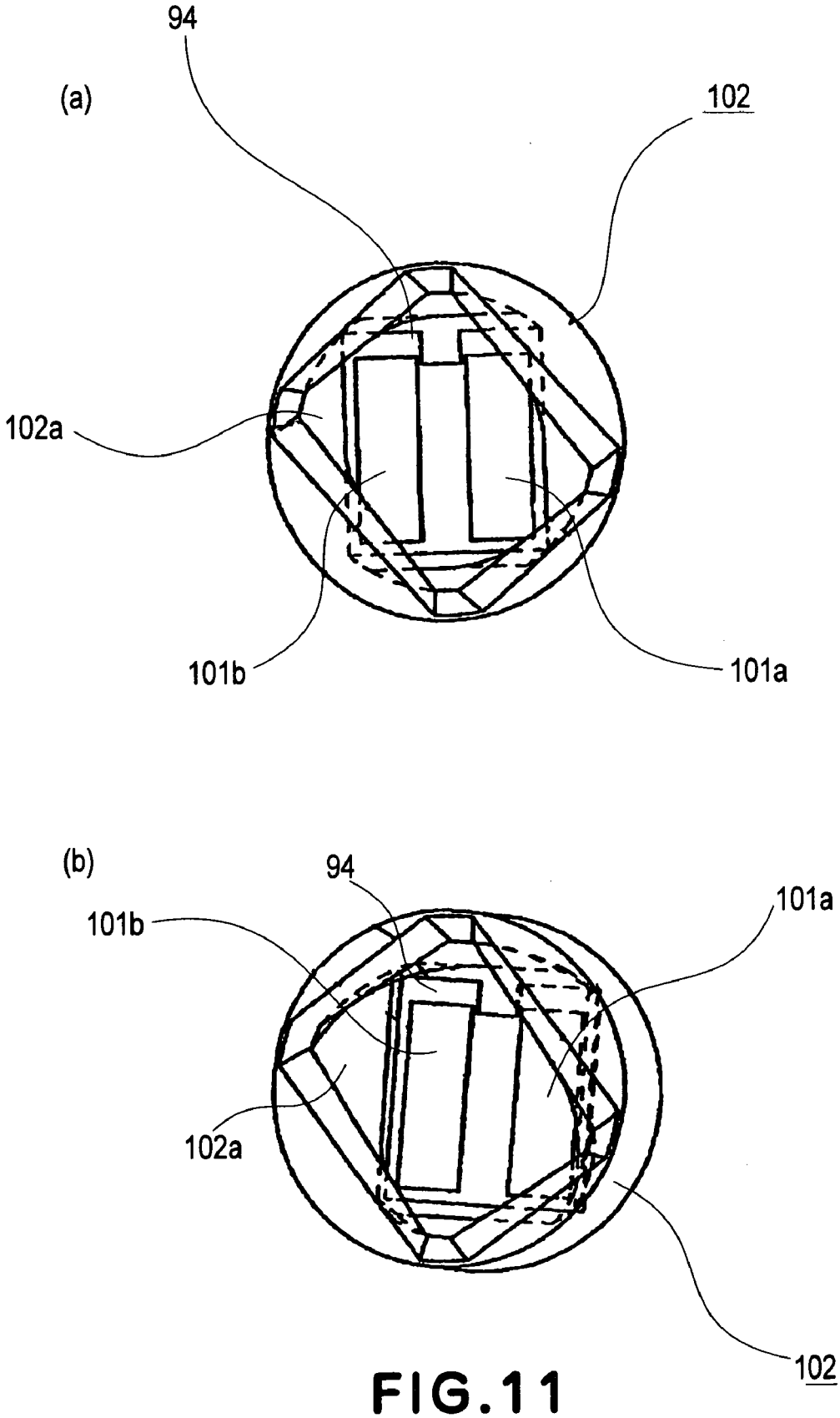
FIGS. 11(*a*) and 11(*b*) are enlarged front and perspective views, respectively, of the connective (coupling) portion of the process cartridge.
Figure 12:
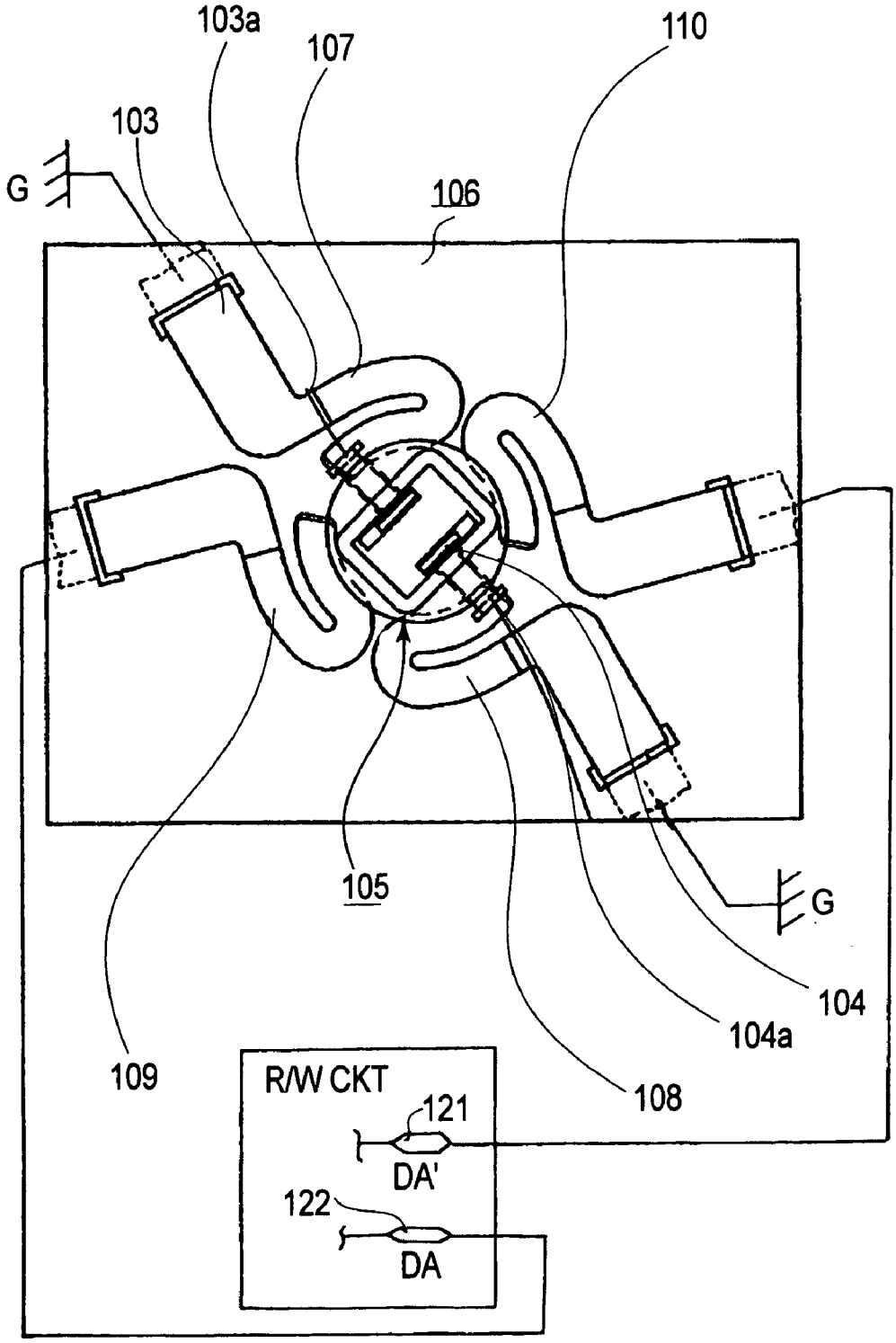
FIG. 12 is an enlarged plan view of the electrical contact supporting member on the main assembly side of the electrophotographic image forming apparatus, and the substrative plate which supports this electrical contact supporting member.
Figure 13:
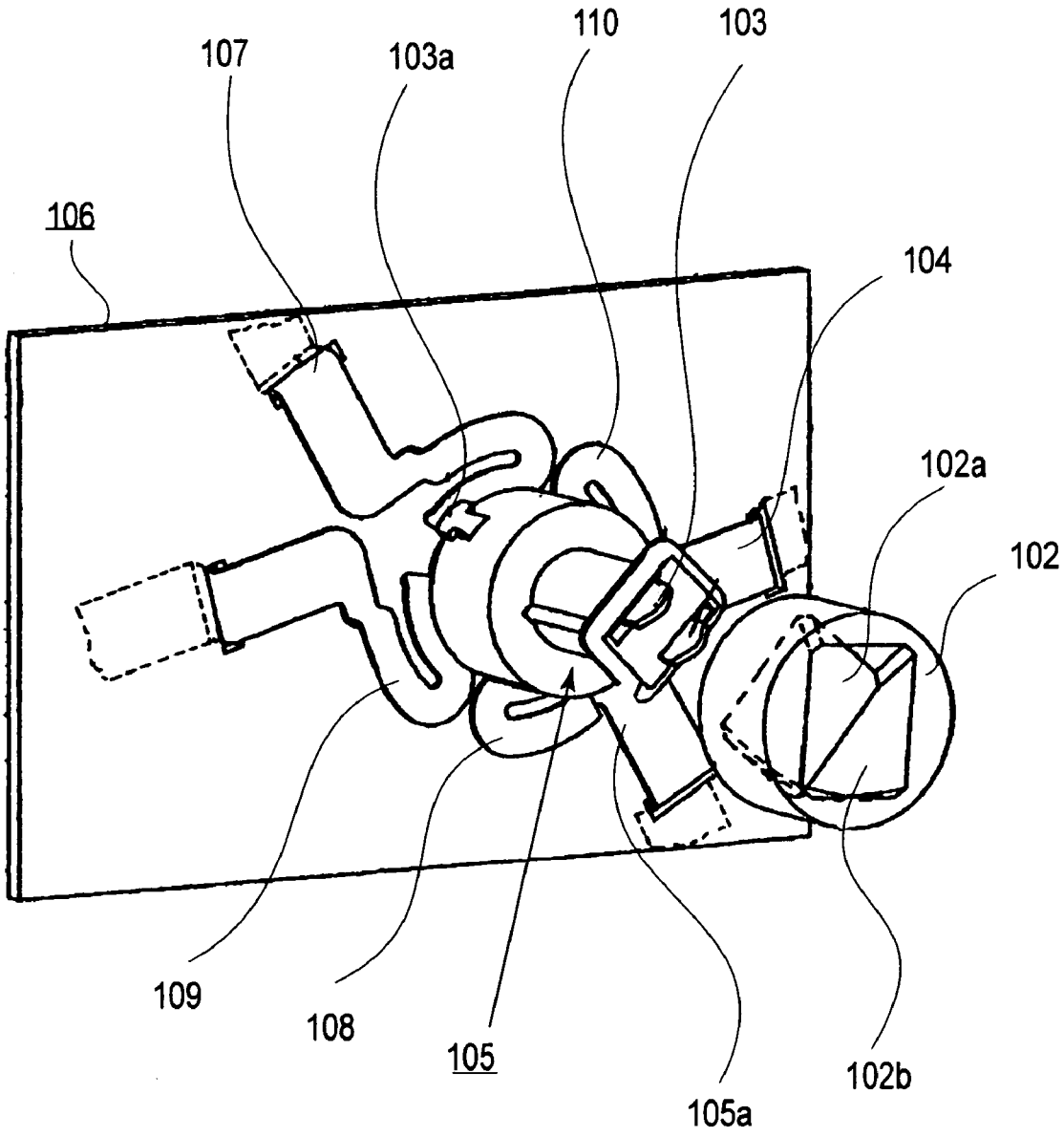
FIG. 13 is a schematic perspective drawing (No. 1) for illustrating the rotational movement of the electrical contact supporting member on the main assembly side of the electrophotographic image forming apparatus, which occurs as the connective (coupling) portion of the process cartridge engages with the electrical contact supporting member on the main assembly side.
Figure 14:
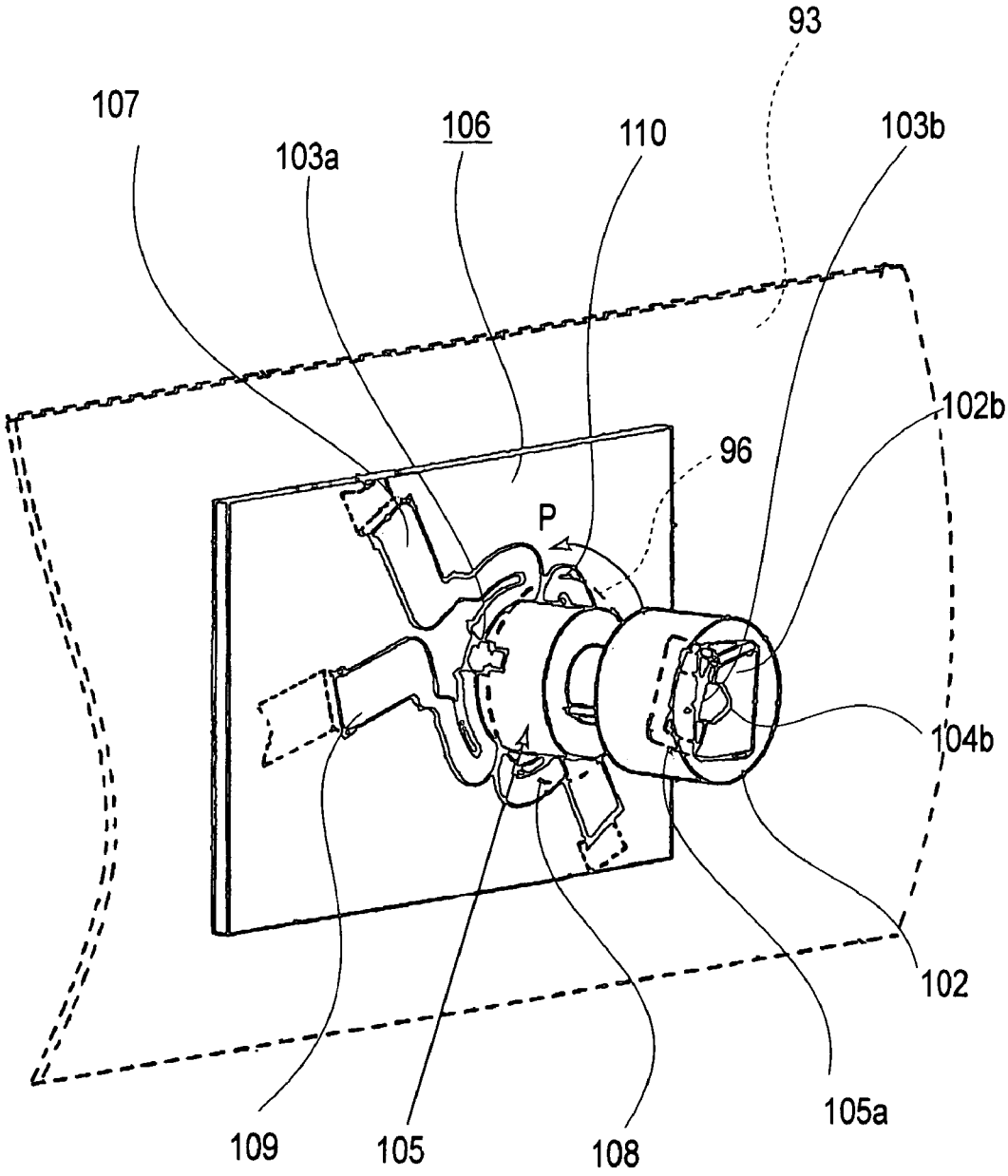
FIG. 14 is a schematic perspective drawing (No. 2) for illustrating the rotational movement of the electrical contact supporting member on the main assembly side of the electrophotographic image forming apparatus, which occurs as the connective portion of the process cartridge engages with the electrical contact supporting member on the main assembly side.
Figure 15:
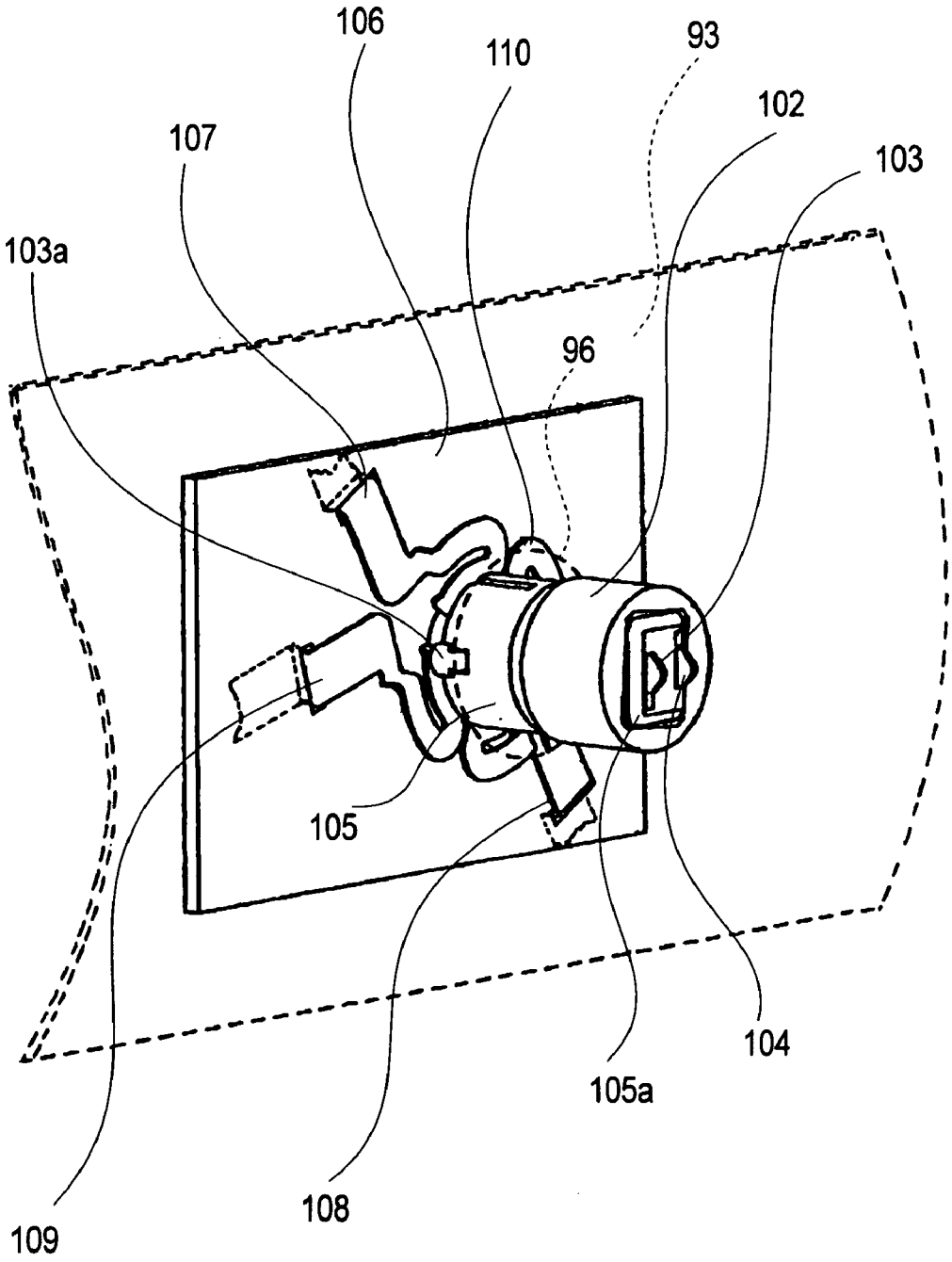
FIG. 15 is a schematic perspective drawing (No. 3) for illustrating the rotational movement of the electrical contact supporting member on the main assembly side of the electrophotographic image forming apparatus, which occurs as the connective portion of the process cartridge engages with the electrical contact supporting member on the main assembly side.
Figure 16:
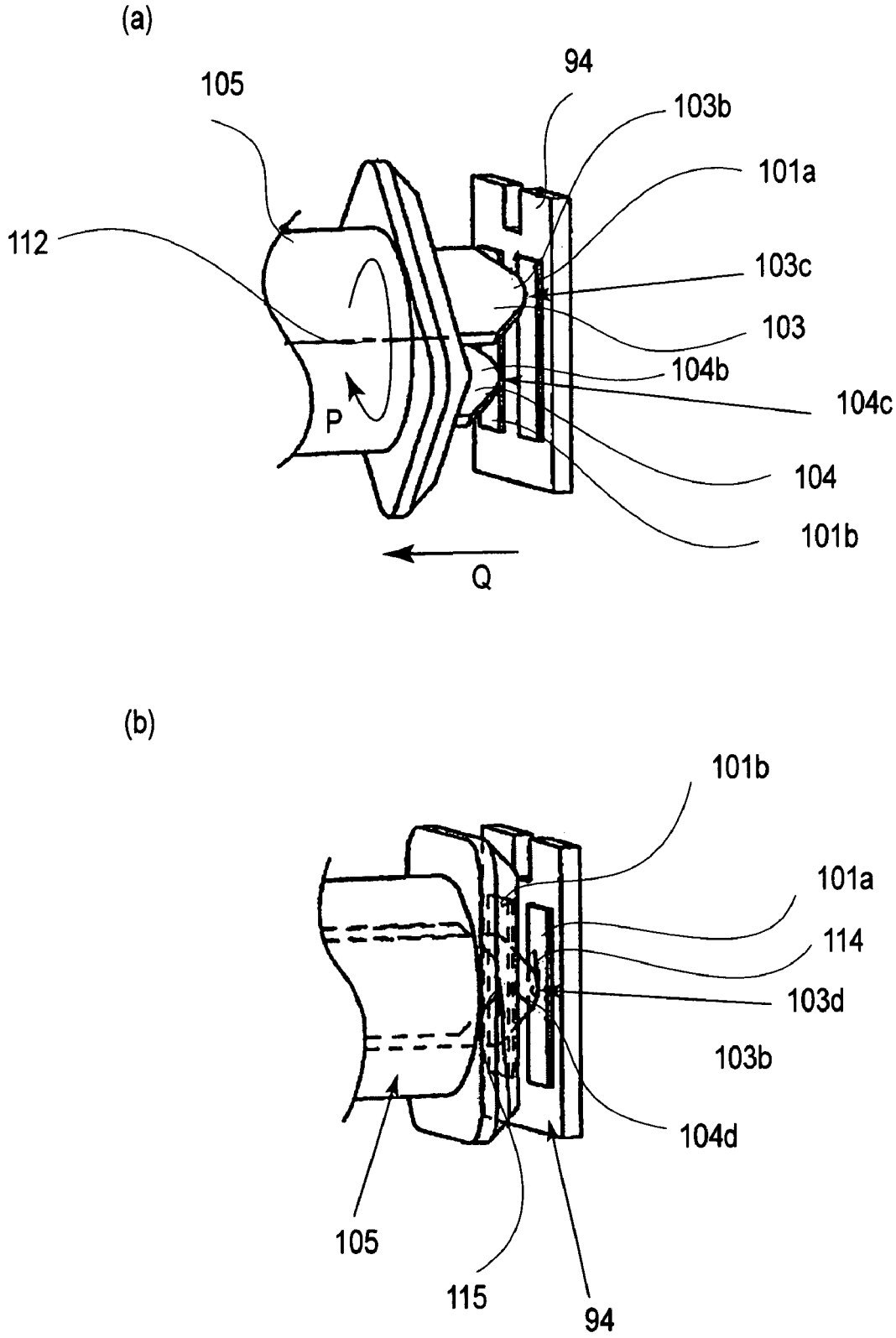
FIGS. 16(*a*) and 16(*b*) are perspective views (No. 1) of the electrical contacts connected to the memory element of the unit, and the electrical contacts on the main assembly side of the electrophotographic image forming apparatus.
Figure 17:
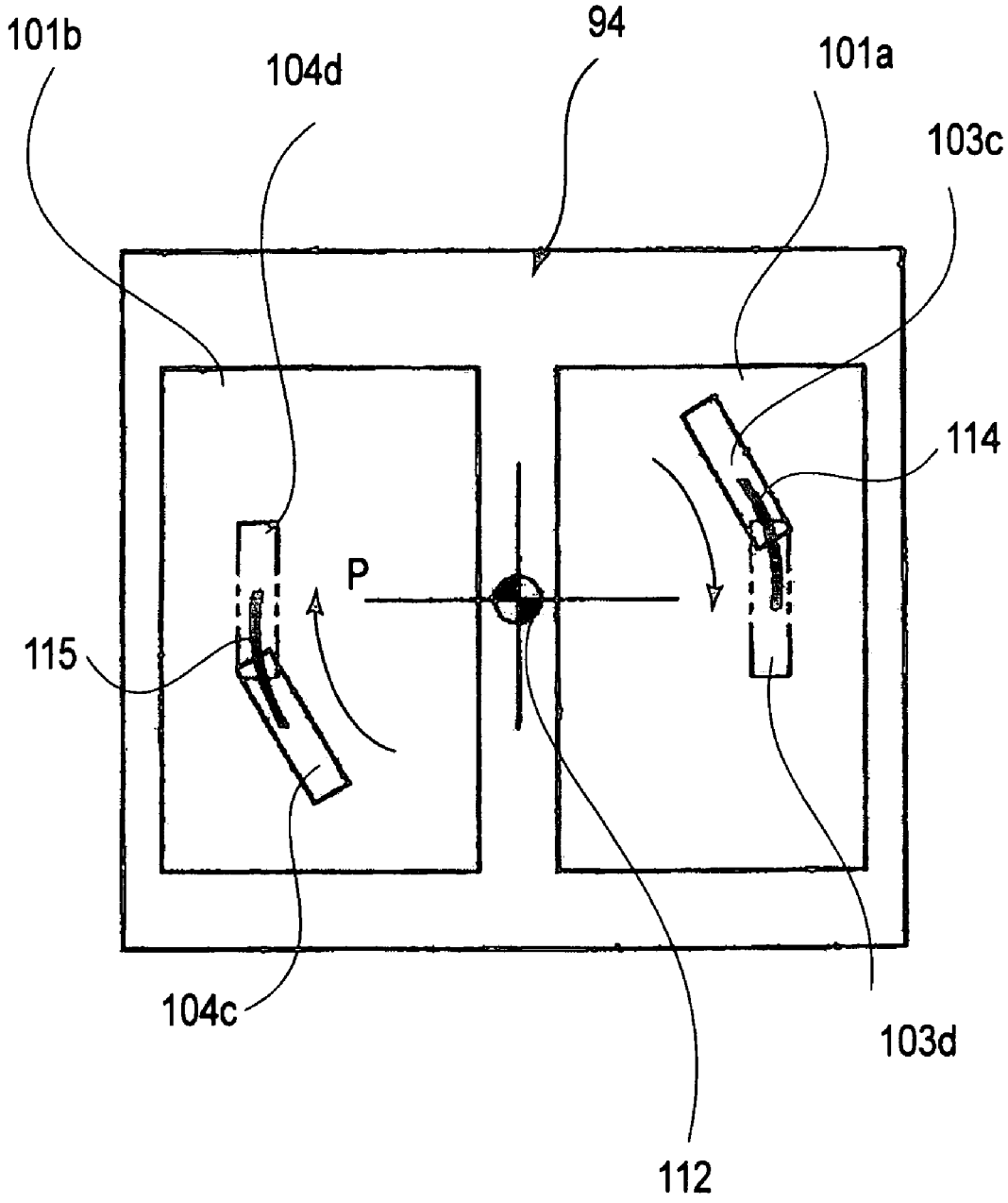
FIG. 17 is a schematic perspective view (No. 2) of the electrical contacts connected to the storage means of the unit, and the electrical contacts on the main assembly side of the electrophotographic image forming apparatus.
Figure 18:
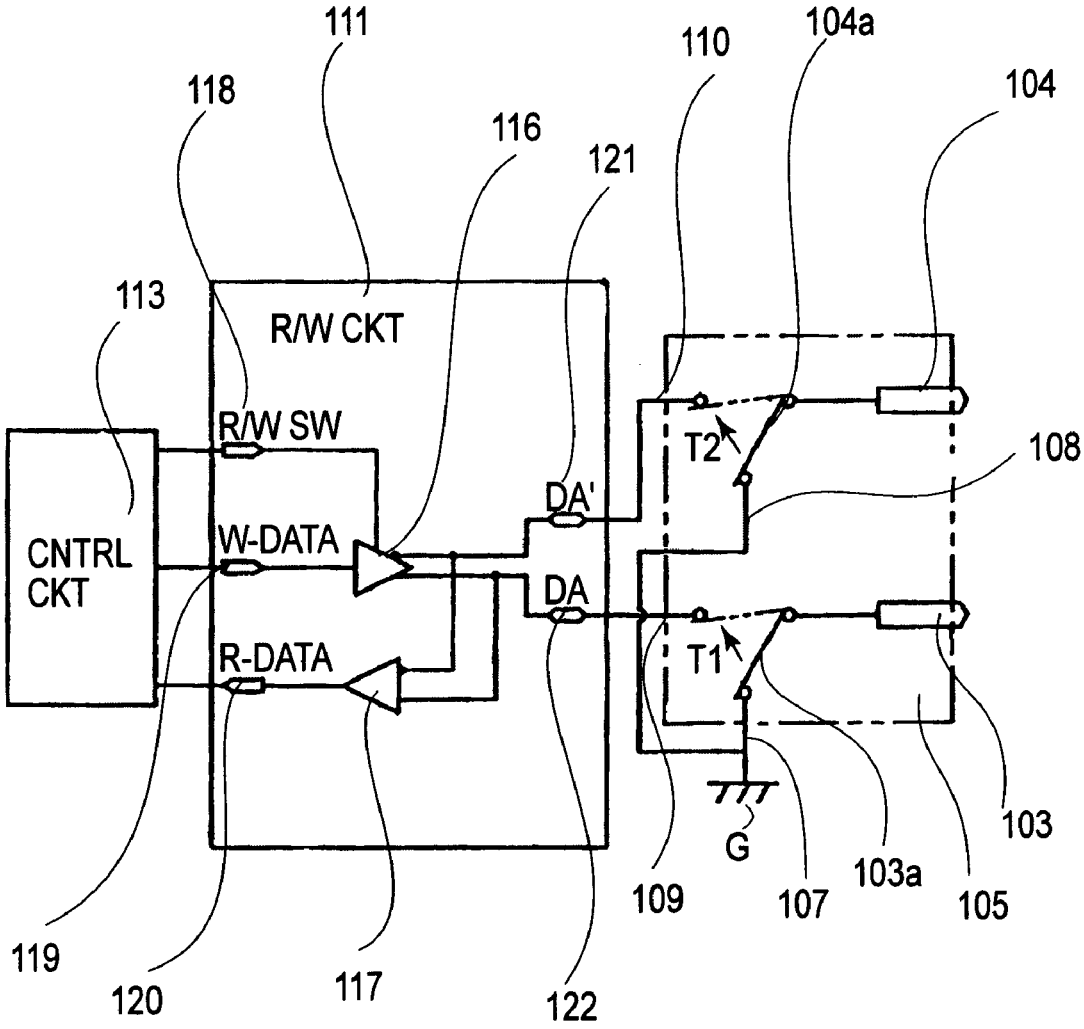
FIG. 18 is a schematic drawing of the electrical wiring for the electrical contacts on the main assembly side of the electrophotographic image forming apparatus.
Figure 19:
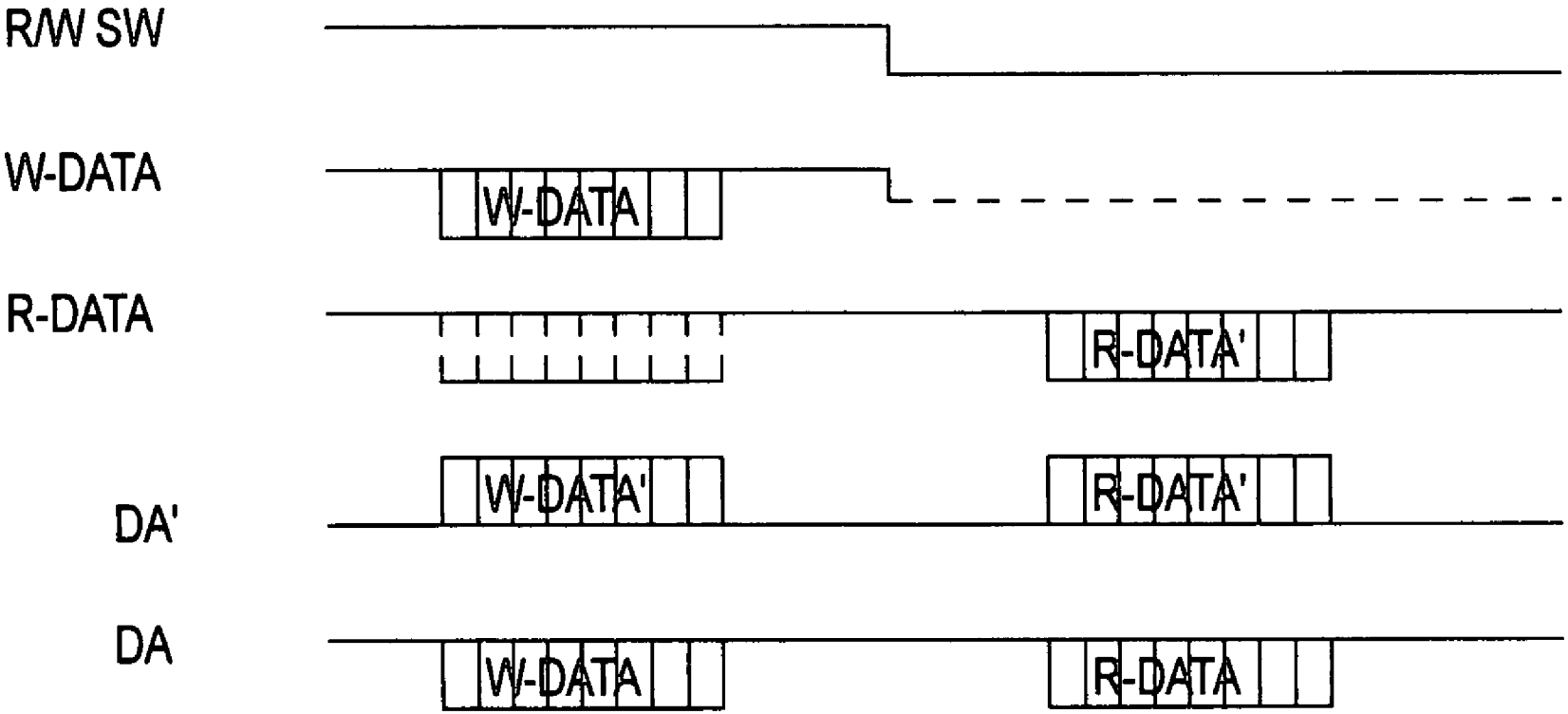
FIG. 19 is a chart of the R/W circuit.

FIG. 10 is a perspective view of the connective (coupling) member 102, and the electrical contact supporting member 105 which corresponds with the connective (coupling) member 102, and FIGS. 11(*a*) and 11(*b*) are enlarged front and perspective views, respectively of the connective (coupling) member 102. FIG. 12 is an enlarged plan view of the combination of the electrical contact supporting member 105 and the substrative plate 106 which supports the electrical contact supporting member 105. FIGS. 13–15 are drawings for describing the rotational movement of the electrical contact supporting member 105, which occurs when it engages with the connective (coupling) member 102. FIGS. 16 and 17 are drawings for describing the electrical contacts on the unit side, and the electrical contacts on the main assembly side. FIG. 18 is a circuit diagram related to the electrical contacts on the main assembly side, and FIG. 19 is the chart of the R/W circuit.

Each cartridge 7 is provided with electrical contacts 101*a* and 101*b* electrically connected to the memory 94 of the cartridge 7. The memory 94 is located on the rear surface of the connective (coupling) member 102, being solidly fixed thereto with the use of two-sided adhesive tape, hot melt or ordinary adhesive, by thermal crimping, or the like method. The connective (coupling) member 102 has a twisted or spiralled hole 102*a*, which is polygonal in cross section. In this embodiment, the cross section of the spiralled hole 102*a* is rectangular.

More specifically, the connective (coupling) member 102 has a recess (hole) 102*a*, into which the end portion (contacting portion) of the electrical contact supporting member 105 engages. The electrical contact supporting member 105 will be described later in more detail. The aforementioned electrical contacts 101*a* and 101*b* are on the bottom surface of this recess 102*a*. The provision of this structural arrangement makes it difficult for a finger to come into contact with the electrical contacts 101*a* and 101*b*, preventing thereby such electrical problems that the electrical contacts 101*a* and 101*b* are contaminated, and/or the memory 94 is adversely affected by static electricity.

The center plate 93 is provided with four rotatable supporting members 105, which support the corresponding electrical contacts 103 and 104 on the main assembly side, which are to be electrically connected to the electrical contacts 101*a* and 101*b* on the unit side. Each supporting member 105 is attached to the substrative plate 106 for supporting the supporting member 105, in such a manner that the supporting member 105 can be rotated about its axis (unshown). Also to the substrative plate 106, the ground contacts 107 and 108 are attached, which are electrically connected to the electrical contacts 103 and 104, respectively, on the main assembly side. The ground contacts 107 and 108 are also connected to the ground of the apparatus main assembly 100. Also to the substrative plate 106, electrical contacts 109 and 110 of the control circuit of the apparatus main assembly 100, are connected. In this embodiment, four electrical contacts are attached to the substrative plate 106: the contacts 107, 108, 109 and 110 connected to the R/W circuit 111 (FIG. 18) which carries out the reading and writing functions, and electrical contacts 103 and 104. The R/W circuit 111 will be described later.

Figure 9:
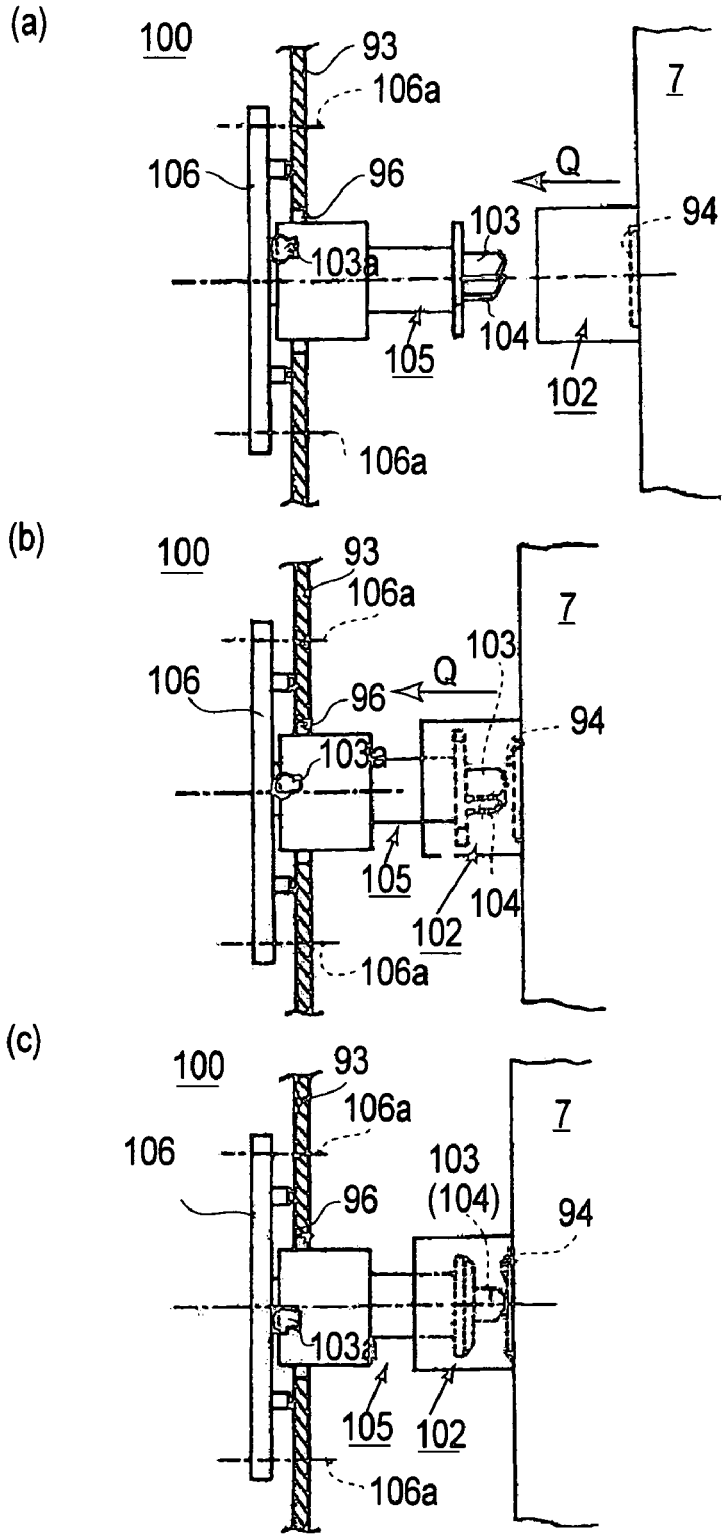
FIGS. 9(*a*)–9(*c*) are schematic side views of the connective (coupling) portion of the process cartridge, and the corresponding portion of the main assembly of the electrophotographic image forming apparatus, showing how the former is connected to the latter.

The substrative plate 106 is attached to the opposite surface of the center plate 93 from the cartridge compartment 200, with fastening jigs 106*a* (FIGS. 9(*a*)–9(*c*)) such as screws, with the supporting member 105 protruding into the cartridge compartment 200 through the hole 96 of the center plate 93.

Before the mounting of the cartridge 7 into the apparatus main assembly 100, sliding portion 103*a* and 104*a* of the electrical contacts 103 and 104 on the main assembly side are in connection to the ground contacts 107 and 108, which are connected to the ground G (FIG. 18) of the apparatus main assembly 100. Also before the mounting of the cartridge 7, the electrical contacts 103 and 104 on the main assembly side are always in contact with the ground G, and the electrical contact supporting member 105 is always under the pressure generated by the return spring (unshown) placed in the supporting member 105, in the direction to keep the electrical contacts 103 and 104 on the main assembly side in contact with the ground contacts 107 and 108.

To describe in more detail with reference to the schematic drawing of the supporting member 105 in FIG. 18, before the mounting of the cartridge 7, the sliding portions 103*a* and 104*a*, that is, one end of the electrical contact 103 on the main assembly side, and one end of the electrical contact 104 on the main assembly side, are electrically in contact with the ground contacts 107 and 108, which are electrically in contact with the ground G. As the cartridge 7 is mounted into the apparatus main assembly 100, the sliding portions 103*a* and 104*a* are moved in the directions indicated by arrow marks T1 and T2, respectively, being thereby electrically connected to the electrical contacts 109 and 110, which are connected to the R/W circuit 111 for reading from, or writing into, the memory 94. The R/W circuit 111 is also connected to the control circuit 113. Thus, as the cartridge 7 is mounted into the apparatus main assembly 100, the electrical contacts 103 and 104 on the main assembly side are electrically connected to the electrical contacts 101*a* and 101*b* on the unit side, allowing the memory 94 and apparatus main assembly 100 to communicate with each other.

That is, as the cartridge (unit) 7 is inserted into the apparatus main assembly 100, the connective (coupling) member 102 engages with the electrical contact supporting member 105, causing thereby the electrical contact supporting member 105 to rotate. As the electrical contact supporting member 105 is rotated, the electrical contacts 103 and 104 on the main assembly side are moved by the rotation of the electrical contact supporting member 105 from the position in which they are electrically in contact with the ground contacts 107 and 108, into the position in which they will be electrically in contact with the electrical contacts 109 and 110. The direction in which the electrical contact supporting member 105 is rotated intersects the direction in which the connective (coupling) member 102 engages with the electrical contact supporting member 105. The direction in which the connective (coupling) member 102 engages with the electrical contact supporting member 105 is parallel to the rotational axis of the electrical contact supporting member 105, and also, is parallel to the axial line of the recess (hole) 102*a*. Therefore, it is ensured that as the cartridge 7 is mounted into the apparatus main assembly 100, the R/W circuit is connected to the memory 94. Further, the electrical connection of the sliding portions 103*a* and 104*a* can be switched by the insertion of the cartridge 7.

Next, referring to FIG. 18, and the chart given in FIG. 19, the signal exchange between the R/W circuit 111 and memory 94 will be described. When writing data into the memory 94 from the control circuit 113, the control circuit 113 raises the R/W switching signal to the H level to send data 119 to be written. Then, the data 119 to be written are sent from the differential driver 116 of the R/W circuit 118 to the DA' signal 121 and DA signal 122. When reading data from the memory 94, the control circuit 113 lowers R/W switching signal 118 to the L level, and receives the data 120 sent from the memory 94 to the DA' signal 121 and DA signal 122, from the signal 120, that is, the output of the differential receiver 117 of the R/W circuit 111.

Next, referring to FIGS. 13–15, the engagement between the connective (coupling) member 102 and supporting member 105 will be described. In FIGS. 13–15, the connective (coupling) member 102 is the only component illustrated from the cartridge side; the structural components on the cartridge side other than the connective (coupling) member 102 are not shown.

Referring to FIG. 13, as the cartridge 7 is inserted into the apparatus main assembly 100, the end portion (contact area) 105*a* of the supporting member 105, which is rectangular in cross section, enters the entrance of the spiral recess (hole) 102*a* of the connective (coupling) member 102. As a result, the end portion 105*a* comes into contact with the twisted internal surfaces 102*b* of the spiral recess of the connective (coupling) member 102.

Next, referring to FIG. 14, as the cartridge 7 is inserted further into the apparatus main assembly 100, the end portion 105*a* of the supporting member 105 enters further into the recess 102*a*, with the end portion (contact area) 105*a* of the supporting member 105 sliding on the twisted internal surfaces 102*b* of the spiral recess 102*a* of the connective (coupling) member 102. In other words, while the end portion 105*a* of the supporting member 105 enters the recess 102*a* of the connective (coupling) member 102, the supporting member 105 is guided by the twisted surface 102*b* of the recess 102*a* of the connective (coupling) member 102. Therefore, the supporting member 105 is rotated in the direction indicated by an arrow mark P against the aforementioned return spring (unshown) in the supporting member 105. The direction indicated by the arrow mark P intersects the direction in which the connective (coupling) member 102 is engaged with the electrical contact supporting member 105 (a direction parallel to the rotational axis of electrical contact supporting member 105).

Figure 21:
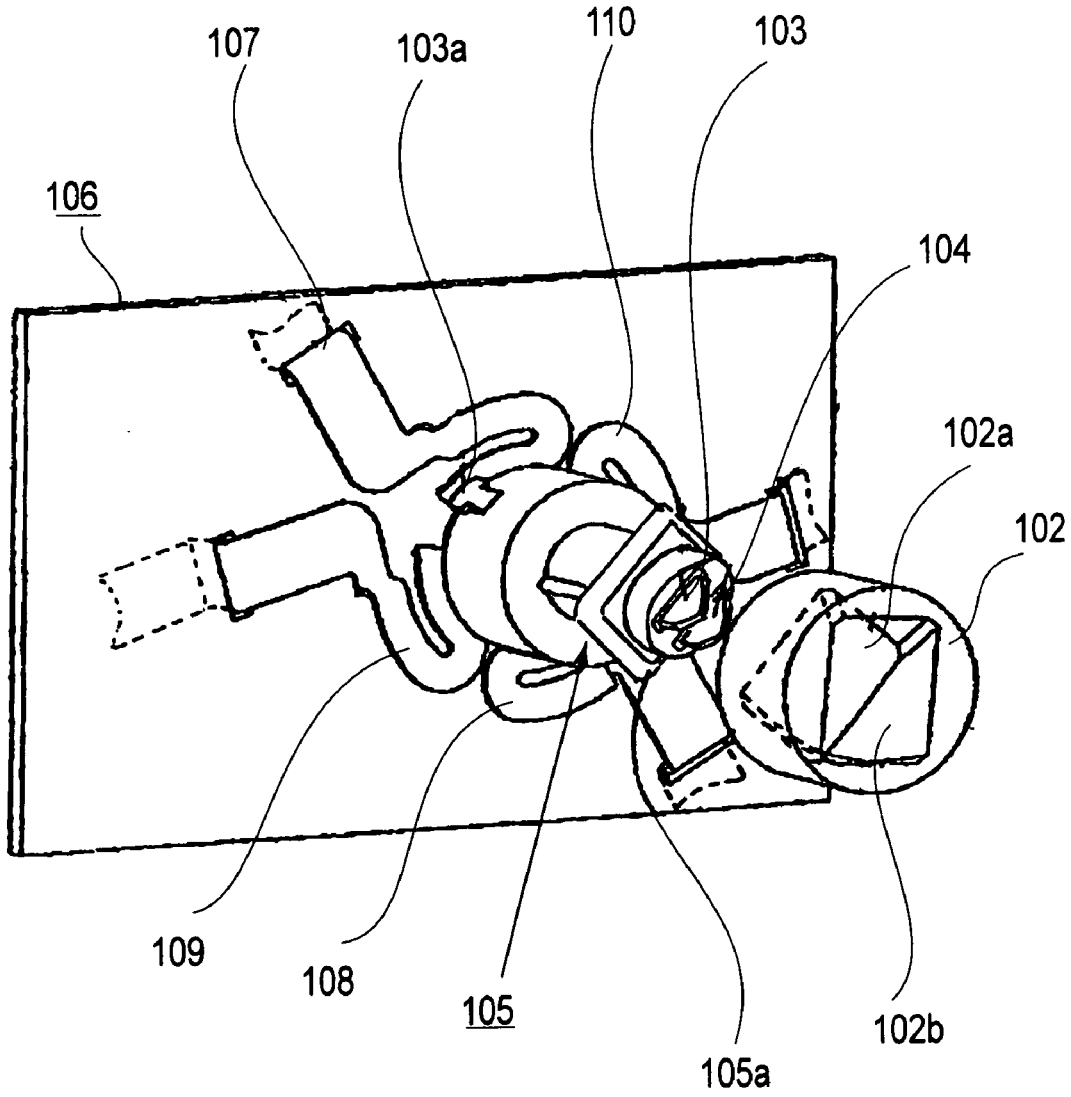
FIG. 21 is a schematic perspective drawing for describing the rotational movement of the electrical contact supporting member on the main assembly side of the electrophotographic image forming apparatus, which occurs as the connective (coupling) portion of the process cartridge engages with the electrical contact supporting member on the main assembly side.

The end portion 105*a*, or engaging portion, may be formed as the mid portion of the supporting member 105 as shown in FIG. 21. Forming the engaging portion 105*a* as the mid portion of the supporting member 105 makes the supporting member 105 stronger against a torsional force. 105 as shown in FIG. 21. Forming the engaging portion 105*a* as the mid portion of the supporting member 105 makes the supporting member 105 stronger against a torsional force.

Referring to FIG. 15, the rotation of the supporting member 105 stops at the end of the mounting of the cartridge 7 into the apparatus main assembly 100, with the sliding portions 103*a* and 104*a* of the electrical contacts 103 and 104 on the main assembly side electrically connected to the electrical contacts 109 and 110, respectively.

In other words, as the cartridge 7 is mounted into the apparatus main assembly 100, the connective (coupling) member 102 engages with the supporting member 105, causing the supporting member 105 to rotate in the direction indicated by the arrow mark P against the aforementioned return spring (unshown) in the supporting member 105. Thus, the sliding portions 103*a* and 104*a* of the electrical contacts 103 and 104 on the main assembly side rotate with the supporting member 105, coming into contact with the electrical contacts 109 and 110, respectively.

Also as the cartridge 7 is inserted into the apparatus main assembly 100, the electrical contacts 103 and 104 of the main assembly become electrically connected to the electrical contacts 101*a* and 101*b* of the unit. The electrical contacts 103 and 104 of the main assembly are elastically supported, being enabled to move, while remaining in contact with the electrical contacts 101*a* and 101*b* on the unit side, in the direction parallel to the lateral wall of the supporting member 105. Thus, when the electrical contacts 103 and 104 on the main assembly side are in contact with the electrical contacts 101*a* and 101*b* connected to the memory 94 of the unit, a certain amount of contact pressure is always maintained between the electrical contacts 103 and 104 and the electrical contacts 101*a* and 101*b*, respectively, by the structural arrangement which elastically supports the electrical contacts 103 and 104.

Next, referring to FIG. 16(*a*), the contact point portions 103*b* and 104*b* of the electrical contacts 103 and 104, respectively, on the main assembly side, which are to come into contact with the electrical contacts 101*a* and 101*b*, on the unit side, leading to the memory 94, come into contact with the electrical contacts 101*a* and 101*b*, by the contact points 103*c* and 104*c* during the mounting of the cartridge 7 into the apparatus main assembly 100. Then, as the cartridge 7 is further inserted (the direction indicated by arrow mark Q in the drawing), the supporting member 105 is rotated about the rotational axis 112 of the supporting member 105. As a result, the contact point portions 103*b* and 104*b* on the main assembly side are moved, in relative tenns, to the positions 103*d* and 104*d*, respectively, as shown in FIG. 16(*b*). In other words, the electrical contacts 103 and 104 on the main assembly side are moved into the positions in which they remain in contact with the electrical contacts 101*a* and 101*b* on the unit side. In this embodiment, a structural arrangement is made so that the rotational angle of the supporting member 105 becomes 45°. With the provision of the above described structural arrangement, as the cartridge 7 is mounted into the apparatus main assembly 100, a pair of slide marks 114 and 115, or traces of the sliding of the electrical contacts 103 and 104, on the main assembly side, are formed on surfaces of the electrical contacts 101*a* and 101*b* on the unit side.

As the electrical contacts 103 and 104 on the main assembly side slide on the electrical contacts 101*a* and 101*b* on the unit side, the contamination, such as dust, having adhered to the electrical contacts on the two sides is removed, ensuring that the satisfactory electrical connection is established between the two sides, that is, between the electrical contacts 101*a* and 103, and between the electrical contacts 101*b* and 104.

Referring to FIG. 17, the electrical contacts 103 and 104 on the main assembly side are positioned away from the rotational axis of the supporting member 105. Therefore, they are caused to slide on the electrical contacts 101*a* and 101*b*, respectively, on the unit side, by the rotation of the supporting member 105.

Incidentally, the portions of the supporting member 105, which are to come into contact with the internal surfaces of the recess of the connective (coupling) member 102, are rectangular in terms of the cross section perpendicular to the axial line of the supporting member 105. However, it does not need to be rectangular as long as it is polygonal and capable of engaging into the recess of the connective (coupling) member 102.

This embodiment of the present invention can bring forth the following effects.

1) Even if a user, who is charged with static electricity, happens to place his hand by mistake in the entrance of the cartridge compartment of the apparatus main assembly 100, in which the cartridge 7 is not present, the electrostatic noise, which is applied to the electrical contacts 103 and 104 on the main assembly side as the hand comes into contact with the electrical contacts 103 and 104, is discharged to the ground G (FIG. 18), protecting thereby the R/W circuit 111. In other words, this embodiment can ensure that the electrical circuit, on the main assembly side of the electrophotographic image forming apparatus, to which the electrical contacts on the main assembly side are connected, is protected.

2) When the cartridge (unit) 7 is inserted into the main assembly of the electrophotographic image forming apparatus, the connective (coupling) member 102 engages with the electrical contact supporting member 105, and rotates the electrical contact supporting member 105, causing thereby the electrical contacts 103 and 104 on the main assembly side to be switched in position from the position in which they are electrically in connection to the ground contacts 107 and 108, respectively, into the position in which they will be electrically connected to electrical contacts 109 and 110, ensuring that the R/W circuit is protected. The connection of the electrical contacts 103 and 104 on the main assembly side can be switched by the insertion of the cartridge 7 into the apparatus main assembly 100.

3) The movement of the cartridge 7 which occurs during the insertion of the cartridge 7 into the apparatus main assembly 100 causes the electrical contacts 103 and 104 on the main assembly side to slide on the electrical contacts

101*a* and 101*b*, respectively, on the unit side, as indicated by the lines 114 and 115 in FIGS. 16(*b*) and 17. Therefore, even if such contaminants that interfere with electrical conduction are on the electrical contacts 103, 104, 101*a*, and 101*b*, they are removed by the sliding of the electrical contacts 103 and 104 on the electrical contacts 101*a* and 101*b*, ensuring that a satisfactory electrical connection is established between the electrical contacts 103 and 104 on the main assembly side and the electrical contacts 101*a* and 101*b* on the unit side, respectively.

4) The removal of contaminants to be accomplished by causing the electrical contacts on the main assembly side to slide on the electrical contacts on the unit side as described in Paragraph 3), is achieved by the insertion of the cartridge 7 into the apparatus main assembly 100. Therefore, it is unnecessary for a user to perform a specific operation dedicated to the removal of the contaminants from the electrical contacts.

5) The memory 94 of the cartridge 7 is placed on the rear surface of the connective (coupling) member 102. Therefore, a user is prevented from unintentionally touching the electrical contacts 101*a* 101*b* connected to the memory 94, being therefore prevented from causing the adhesion of contaminants or the like to the electrical contacts 101*a* and 101*b*, when handling the cartridge 7.

(5) Structural Modifications

Figure 20:
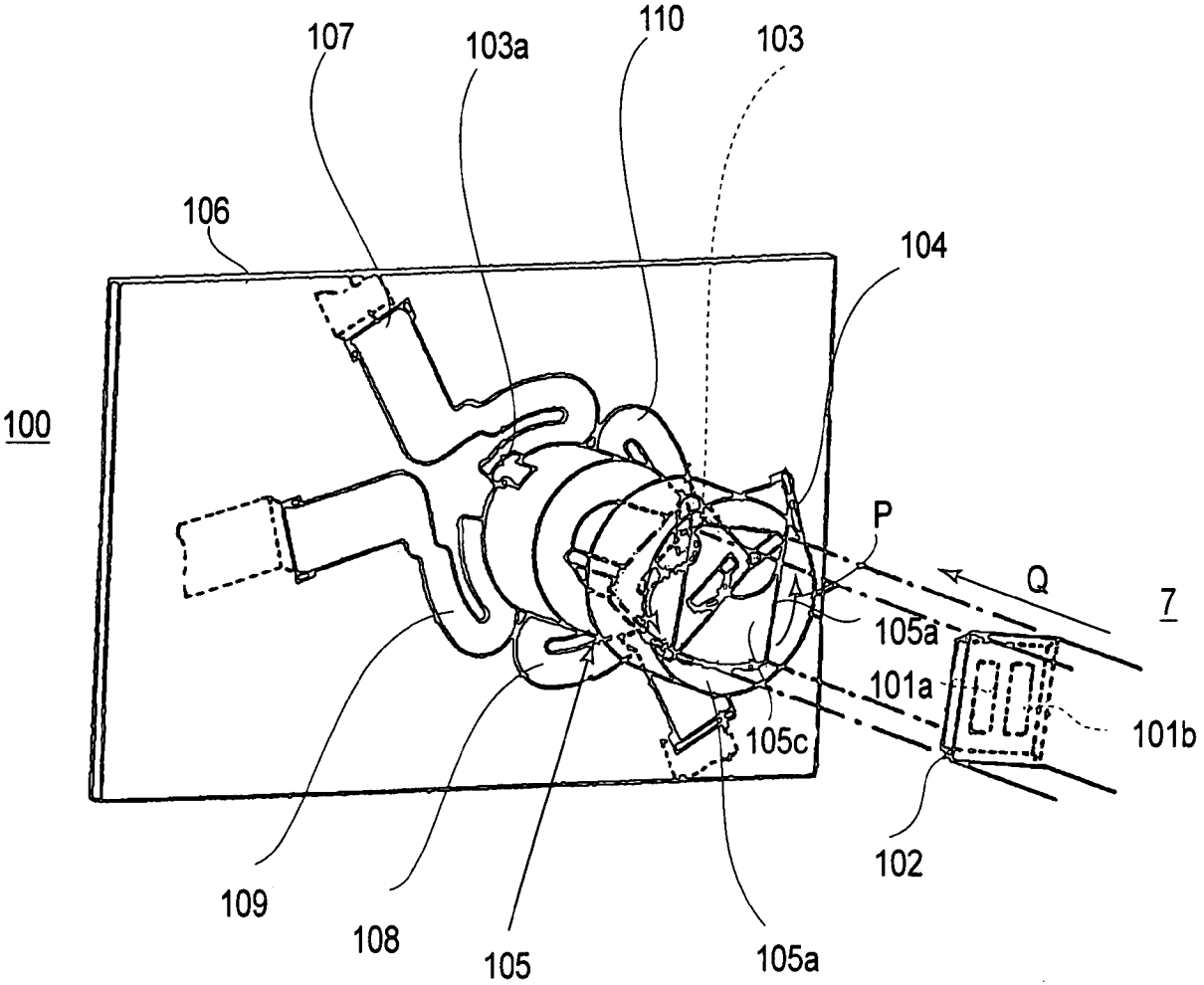
FIG. 20 is a schematic perspective view of one of the modifications of the first embodiment, regarding the connective (coupling) portion of the process cartridge, and the electrical contact supporting member, on the main assembly side, which corresponds to the connective portion of the process cartridge.

1) Regarding the shapes of the connective (coupling) member 102 and electrical contact supporting member 105, the relationship between the connective (coupling) member 102 and electrical contact supporting member 105 in terms of which of the two is given a projection (or recess) may be reversed as shown in FIG. 20.

More specifically, the end portion of the supporting member 105 may be provided with a member 105*a* having a spiral hole (recess) 105*b* which has a polygonal cross section, and the internal surfaces 105*c* of which are twisted, whereas the connective (coupling) member 102 may be provided with a projection which engages into the hole 105*b* of the member 105*a* of the supporting member 105. This structural arrangement also can rotate the supporting member 105.

2) The preceding embodiment was described with reference to the electrophotographic color image forming apparatus employing one of the developing methods of the contact type, and the process cartridge therefor. However, the present invention is also applicable to an electrophotographic monochromatic image forming apparatus employing one of the developing methods of the non-contact type as well as the contact type, a development unit mountable in the main assembly of electrophotographic image forming apparatus, and a developer unit which holds developer.

3) Further, the preceding embodiment was described with reference to the mechanism for establishing an electrical connection between the memory of the process cartridge and the main assembly of the electrophotographic image forming apparatus. However, the present invention is also applicable to the mechanism for applying voltage to the charging member and the mechanism for applying voltage to the developing member.

Moreover, it is feasible to apply this embodiment to the fixation unit for fixing an unfixed image on the recording medium to the recording medium.

4) Also, the preceding embodiment was described with reference to the structural arrangement in which the internal surfaces of the coupler portion of the process cartridge were twisted. However, the embodiment is not intended to limit the scope of the present invention. In other words, all that is necessary is for the internal surfaces of the coupler portion of the process cartridge to be shaped so that they can rotate the electrical contact supporting member. For example, they may be shaped so that their lateral edges are simply angled relative to the axial line of the electrical contact supporting member.

As described above, according to the present invention, when a unit (process cartridge) is mounted into the main assembly of an electrophotographic image forming apparatus, electrical connection is more reliably established between the electrical contacts of the main assembly of the electrophotographic image forming apparatus, and the electrical contacts of the unit (process cartridge), than according to the prior art.

Also according to the present invention, when a unit (process cartridge) is mounted into the main assembly of an electrophotographic image forming apparatus, the electrical contacts on the main assembly side slide on the electrical contacts of the unit (cartridge), removing thereby the contaminants on the both sides.

Further, the present invention ensures that the electrical circuit, on the main assembly side of an electrophotographic image forming apparatus, to which the electrical contacts on the main assembly side are connected, is protected.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application Nos. 024341/2004 and 014097/2005 filed Jan. 30, 2004 and Jan. 21, 2005, respectively, which are hereby incorporated by reference.

What is claimed is:

1. A unit detachably mountable to a main assembly of an electrophotographic image forming apparatus, the electrophotographic image forming apparatus including a main assembly electrical contact and a rotatable electrical contact supporting member configured and positioned to support the main assembly electrical contact, said unit comprising:

a unit electrical contact configured and positioned to electrically connect to the main assembly electrical contact when said unit is mounted to the main assembly of the apparatus; and an engaging portion configured and positioned to engage the electrical contact supporting member when said unit is inserted into the main assembly of the apparatus, said engaging portion being effective to cause a rotational motion of the electrical contact supporting member in a direction crossing an engaging direction in which said engaging portion is brought into engagement with the electrical contact supporting member, when said unit is being inserted into the main assembly of the apparatus, wherein a sliding motion is imparted between said unit electrical contact and the main assembly electrical contact as a result of said engaging portion causing the rotational motion of said electrical contact supporting member, with said unit electrical contact and the main assembly electrical contact contacting each other, and wherein when said unit is mounted to the main assembly of the apparatus, the rotational motion of the electrical contact supporting member is effective to move the main assembly electrical contact from a position for electrical connection with a grounding contact provided in the main assembly of the apparatus to a position for electrical connection with a connecting contact provided in the main assembly of the apparatus, wherein the connecting contact is electrically connected with control means provided in the main assembly of the apparatus.

2. A unit according to claim 1, further comprising a memory element storing information usable for the formation of an image, said memory element being electrically connected with said unit electrical contact.

3. A unit according to claim 1, wherein said engaging portion is in the form of a twisted recess of said unit having a polygonal cross-section, and said unit electrical contact is provided on a bottom of said recess.

4. A unit according to claim 3, wherein said engaging direction is parallel to an axis of said recess.

5. A unit according to claim 1, wherein said engaging portion is disposed at a leading end of said unit with respect to a mounting direction in which said unit is mounted to the main assembly of the apparatus.

6. A process cartridge detachably mountable to a main assembly of an electrophotographic image forming apparatus, the electrophotographic image forming apparatus including a main assembly electrical contact and a rotatable electrical contact supporting member configured and positioned to support the main assembly electrical contact, said unit comprising:

an electrophotographic photosensitive member;

a process device actable on said electrophotographic photosensitive member;

a cartridge electrical contact configured and positioned to electrically connect to the main assembly electrical contact when said process cartridge is mounted to the main assembly of the apparatus; and an engaging portion configured and positioned to engage the electrical contact supporting member when said process cartridge is inserted into the main assembly of the apparatus, said engaging portion being effective to cause a rotational motion of the electrical contact supporting member in a direction crossing an engaging direction in which said engaging portion is brought into engagement with the electrical contact supporting member, when said process cartridge is being inserted into the main assembly of the apparatus, wherein a sliding motion is imparted between said cartridge electrical contact and the main assembly electrical contact as a result of said engaging portion causing the rotational motion of said electrical contact supporting member, with said cartridge electrical contact and the main assembly electrical contact contacting each other, and wherein when said process cartridge is mounted to the main assembly of the apparatus, the rotational motion of the electrical contact supporting member is effective to move the main assembly electrical contact from a position for electrical connection with a grounding contact provided in the main assembly of the apparatus to a position for electrical connection with a connecting contact provided in the main assembly of the apparatus, wherein the connecting contact is electrically connected with control means provided in the main assembly of the apparatus.

7. A process cartridge according to claim 6, wherein, further comprising a memory element storing information usable for the formation of an image, said memory element being electrically connected with said cartridge electrical contact.

8. A process cartridge claim 6, wherein said engaging portion is in the form of a twisted recess of said cartridge having a polygonal cross-section, and said cartridge electrical contact is provided on a bottom of said recess.

9. A process cartridge according to claim 8, wherein said engaging direction is parallel to an axis of said recess.

10. A process cartridge according to claim 6, wherein said engaging portion is disposed at a leading end of said process cartridge with respect to a mounting direction in which said process cartridge is mounted to the main assembly of the apparatus.

11. An electrophotographic image forming apparatus for forming an image on a recording material, wherein a unit is detachably mountable to a main assembly of said electrophotographic image forming apparatus, said apparatus comprising:

(i) a main assembly electrical contact;

(ii) a rotatable electrical contact supporting member configured and positioned to support said main assembly electrical contact;

(iii) a mounting device configured and positioned to detachably mount the unit, the unit including, a cartridge electrical contact configured and positioned to electrically connect with said main assembly electrical contact when the unit is mounted to said main assembly of said apparatus, and an engaging portion configured and positioned to engage said electrical contact supporting member when the unit is inserted into said main assembly of said apparatus, the engaging portion being effective to cause a rotational motion of said electrical contact supporting member in a direction crossing an engaging direction in which the engaging portion is brought into engagement with said electrical contact supporting member, when the unit is being inserted into said main assembly of said apparatus, wherein a sliding motion is imparted between the unit electrical contact and said main assembly electrical contact as a result of the engaging portion causing the rotational motion of said electrical contact supporting member, with the unit electrical contact and said main assembly electrical contact contacting each other; and (iv) a feeding device configured and positioned to feed the recording material;

(vi) a control device;

(vii) a grounding contact which is electrically grounded; and (viii) a connecting contact electrically connected with said control device, and wherein when the unit is mounted to said main assembly of said apparatus, the rotational motion of said electrical contact supporting member is effective to move said main assembly electrical contact from a position for electrical connection with said grounding contact to a position for electrical connection with said connecting contact.

12. An apparatus according to claim 11, wherein said electrical contact supporting member has an engaging part configured and positioned to engage the engaging portion, said engaging part having a polygonal cross-section.

13. An apparatus according to claim 11, wherein the engaging direction is parallel to an axis of said electrical contact supporting member.

14. An electrophotographic image forming apparatus for forming an image on a recording material, wherein a process cartridge is detachably mountable to a main assembly of said electrophotographic image forming apparatus, said apparatus comprising:

(i) a main assembly electrical contact;

(ii) a rotatable electrical contact supporting member configured and positioned to support said main assembly electrical contact;

(iii) a mounting device configured and positioned to detachably mount the process cartridge, the process cartridge including a cartridge electrical contact configured and positioned to electrically connect to said main assembly electrical contact when the process cartridge is mounted to said main assembly of said apparatus, and an engaging portion configured and positioned to engage said electrical contact supporting member when the cartridge is inserted into said main assembly of said apparatus, the engaging portion being effective to cause a rotational motion of said electrical contact supporting member in a direction crossing an engaging direction in which the engaging portion is brought into engagement with said electrical contact supporting member, when the process cartridge is being inserted into said main assembly of said apparatus, wherein a sliding motion is imparted between the cartridge electrical contact and said main assembly electrical contact as a result of by the engaging portion causing the rotational motion of said electrical contact supporting member, with the cartridge electrical contact and said main assembly electrical contact contacting each other; and (iv) a feeding device configured and positioned to feed the recording material;

(v) a control device:

(vi) a grounding contact which is electrically grounded: and (vii) a connecting contact electrically connected with said control device means, and wherein when the process cartridge is mounted to said main assembly of said apparatus, the rotational motion is effective to move said main assembly electrical contact from a position for electrical connection with said grounding contact to a position for electrical connection with said connecting contact.

15. An apparatus according to claim 14, wherein said electrical contact supporting member has an engaging part configured and positioned to engage the engaging portion, the engaging part having a polygonal cross-section.

16. An apparatus according to claim 14, wherein the engaging direction is parallel to an axis of said electrical contact supporting member.

* * * * *

UNITED STATES PATENT AND TRADEMARK OFFICE

CERTIFICATE OF CORRECTION

PATENT NO. : 7,136,604 B2
APPLICATION NO. : 11/044062
DATED : November 14, 2006
INVENTOR(S) : Kazuo Chadani et al.

It is certified that error appears in the above-identified patent and that said Letters Patent is hereby corrected as shown below:

COLUMN 2:
Line 25, "6,p." should read --6, p.--.

COLUMN 23:
Line 63, "wherein," should be deleted.

COLUMN 24:
Line 1, "cartridge" should read --cartridge according to--.

COLUMN 25:
Line 23, "by" should be deleted.

Signed and Sealed this

Fifth Day of August, 2008

JON W. DUDAS
*Director of the United States Patent and Trademark Office*